US011365614B2

(12) United States Patent
Purcell

(10) Patent No.: US 11,365,614 B2
(45) **Date of Patent: *Jun. 21, 2022**

(54) SYSTEM, APPARATUS AND METHOD FOR ARTIFICIAL LIFT, AND IMPROVED DOWNHOLE ACTUATOR FOR SAME

(71) Applicant: PCS Oilfield Services, LLC, Canadian, TX (US)

(72) Inventor: Ed Purcell, Canadian, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/968,345

(22) Filed: May 1, 2018

(65) Prior Publication Data

US 2018/0363432 A1 Dec. 20, 2018

Related U.S. Application Data

(63) Continuation-in-part of application No. 15/471,189, filed on Mar. 28, 2017, now Pat. No. 10,526,878, which is a continuation of application No. 15/133,891, filed on Apr. 20, 2016, now Pat. No. 9,617,838.

(60) Provisional application No. 62/150,147, filed on Apr. 20, 2015.

(51) Int. Cl.

| | |
|---|---|
| ***E21B 43/12*** | (2006.01) |
| ***E21B 47/00*** | (2012.01) |
| ***E21B 47/08*** | (2012.01) |
| ***E21B 17/02*** | (2006.01) |
| ***F04B 47/00*** | (2006.01) |
| ***F04B 47/08*** | (2006.01) |

(52) U.S. Cl.

CPC ..... *E21B 43/129* (2013.01); *E21B 17/02* (2013.01); *E21B 43/126* (2013.01); *F04B 47/00* (2013.01); *F04B 47/08* (2013.01)

(58) Field of Classification Search

CPC ..... E21B 43/129; E21B 43/12–129; E21B 34/00; E21B 34/06–16; E21B 17/02; E21B 43/13; E21B 17/041; E21B 23/04; F04B 47/00–145

USPC ..... 166/68, 72, 369, 372

See application file for complete search history.

(56) References Cited

U.S. PATENT DOCUMENTS

| | | | | |
|---|---|---|---|---|
| 5,494,102 | A * | 2/1996 | Schulte | E21B 43/129 166/105.6 |
| 2006/0207759 | A1 | 9/2006 | Bearden et al. | |
| 2008/0087437 | A1 | 4/2008 | Crawford | |
| 2009/0145595 | A1 | 6/2009 | Mazzanti | |
| 2009/0283264 | A1 | 11/2009 | Sonchia | |
| 2010/0300701 | A1 | 12/2010 | Bullen | |
| 2014/0014318 | A1 | 1/2014 | Mail | |

* cited by examiner

*Primary Examiner* — George S Gray

(57) ABSTRACT

An artificial lift system may include a rodless hydraulic pump actuator including an actuator housing assembly, an actuator piston assembly supported for reciprocal translation stroke movement relative to the actuator piston assembly, an actuator piston assembly production fluid passage extending through the actuator piston assembly, and a tubular coupling below the actuator housing assembly having a coupling flow passage to pass production fluid into the actuator piston assembly production fluid passage.

12 Claims, 42 Drawing Sheets

1610
1626
1622
1624
1620

1610
1624
1620
1629
1617

1610
1626
1615
1629
1618
1622
1617
29
29

SYSTEM, APPARATUS AND METHOD FOR ARTIFICIAL LIFT, AND IMPROVED DOWNHOLE ACTUATOR FOR SAME

CROSS-REFERENCE TO RELATED APPLICATIONS

This application is related and claims priority to the following: U.S. patent application Ser. No. 15/471,189 filed Mar. 28, 2017, entitled "SYSTEM, APPARATUS AND METHOD FOR ARTIFICIAL LIFT, AND IMPROVED DOWNHOLE ACTUATOR FOR SAME"; is related to U.S. patent application Ser. No. 15/133,891 filed Apr. 20, 2016, from which U.S. Pat. No. 9,617,838 was issued on Apr. 11, 2017, entitled "SYSTEM, APPARATUS AND METHOD FOR ARTIFICIAL LIFT, AND IMPROVED DOWNHOLE ACTUATOR FOR SAME"; is related to U.S. Provisional Application No. 62/150,147 filed Apr. 20, 2015 entitled "SYSTEM, APPARATUS AND METHOD FOR ARTIFICIAL LIFT, AND IMPROVED DOWNHOLE ACTUATOR FOR SAME"; and, each of the aforementioned related applications is hereby incorporated by reference in entirety.

FIELD OF THE INVENTION

The present disclosure relates to systems, apparatuses and methods for artificial lift of fluids such as hydrocarbons from production wells. Embodiments relate to systems, apparatuses and methods for artificial lift, including a down-hole pump actuator.

BACKGROUND OF THE INVENTION

The installation and operation of production wells for producing hydrocarbons from underground formations are accompanied by various problems that remain unresolved despite the passing of more than a century since inception of the hydrocarbon energy industry. Disclosed subject matter includes improved systems, apparatuses and methods for artificial lift, without requiring a sucker rod string or pump jack. Embodiments may provide systems, apparatuses, and methods for artificial lift including a hydraulic downhole pump actuator. Embodiments may comprise an actuator for pumping or lifting crude oil, hydrocarbons or fluids ("fluids") from an underground area in a production well. Embodiments may provide a production well comprising a hydraulic downhole pump actuator. Embodiments may include a method for artificial lift for production of hydrocarbons from a well.

BRIEF SUMMARY OF THE INVENTION

The disclosed subject matter provides a system, apparatus and method for artificial lift. Embodiments of disclosed subject matter provide systems and apparatuses for artificial lift including a hydraulic downhole pump actuator, and methods for artificial lift using the same, as these are further described herein. Embodiments may provide energy and cost savings, reduced maintenance, reduced maintenance downtime, reduced complexity, increased precision in control, increased precision of pumping actuation, increased useful life of artificial lift equipment, reduced mechanical loads on equipment, and apparatus and systems of simplified construction and operation. This disclosure identifies various problems and limitations associated with the installation and operation of rod-pumped production wells having a pump jack at the ground surface raising and lowering a sucker rod string that supports a pump head, in numerous pump cycles per hour. For example, according to the present disclosure, it is recognized that installing a rod-pumped well imposes undesired limitations on geometry, construction and operation of the well. For example, to the extent the production tubing deviates from vertical and straight from top to bottom, the sucker rod may rub or bind against the wall of the production tubing in one or more locations, so that the sucker rod wears excessively in those locations, and the well operator faces increased expense to maintain or replace the sucker rod to accommodate the excess wear. Problems with the operation of rod-pumped production wells also include expense, time, manpower, operating downtime, and replacement or reconditioning burdens to maintain the sucker rod, including the necessity for a crew using a cherry picker or similar crane to undertake the time-consuming work of pulling, servicing and replacing the sucker rod string that runs from the surface down to the bottom of the well. Another problem, even where the production is vertical and straight, is the expense and burden of ordinary wear on the sucker rod string, which is thousands of feet in length, due to ordinary stresses and loads on the sucker rod string across many tens of thousands of repeated cycles of being lowered and raised by the pump jack. Another problem with operation of rod-pumped production wells is inefficiency in the consumption of energy required to articulate the pump jack in cyclical operation to lift the entire sucker rod string, several thousand feet in length, in order to lift hydrocarbon fluids from the bottom of the well to the surface. Another problem is the capital cost of the sucker rod string and pump jack. A further problem is that production wells constructed by hydraulic fracturing may include a non-vertical or directional section at bottom of the wellbore, extending outward into the reservoir from the major vertical section of the wellbore running from ground surface down to a transition, turn or curve into the non-vertical section. The transition, turn or curve from the vertical section into the horizontal or non-vertical section may prevent a rod-pumped sucker rod string from extending into the non-vertical section of the well, and this also may interfere with, or altogether prevent, utilization of a plunger pump sized for production efficiency from being located in the zone where hydrocarbons are produced. A further problem is that geometry and size of the pump jack may limit vertical travel of the sucker rod string and attached plunger pump, even where geometry such as depth of the reservoir or formation from which hydrocarbons might be produced otherwise would permit operation using a longer stroke of the sucker rod string and attached plunger pump. Each of the preceding shortcomings may cause or contribute to undesired expense and inefficiencies, which have been unrecognized and/or acquiesced to by those of ordinary skill in the field of art. A further problem is that, although downhole plunger pumps configured to be actuated by a sucker rod are commonly available, pre-existing plunger pumps cannot be re-used where different types of artificial lift systems are placed into service.

These and other advantages of the disclosed subject matter, as well as additional novel features, will be apparent from the description provided herein. Disclosed subject matter includes systems, apparatuses, methods for artificial lift of fluids such as hydrocarbons in production wells, which include a rodless hydraulic downhole actuator for a plunger pump, which may overcome problems as disclosed above, and which also may have other advantages.

This summary is not a comprehensive description of the subject matter disclosed in this application, but rather is intended to provide a short overview of some structure, functionality and advantages of the subject matter disclosed herein. Other systems, apparatuses, methods, features and advantages here provided will become apparent to one with ordinary skill in the art upon examination of the following FIGURES and detailed description. It is intended that all such additional systems, methods, features and advantages included within this description, be within the scope of the claims.

BRIEF DESCRIPTION OF THE DRAWINGS

Novel features believed characteristic of the disclosed subject matter will be set forth in any claims that are filed. The disclosed subject matter itself, however, as well as modes of use, further objectives, and advantages thereof, will best be understood by reference to the following detailed description of illustrative embodiments when read in conjunction with the accompanying drawings, wherein:

DETAILED DESCRIPTION OF ILLUSTRATIVE EMBODIMENTS

Figure 1A:
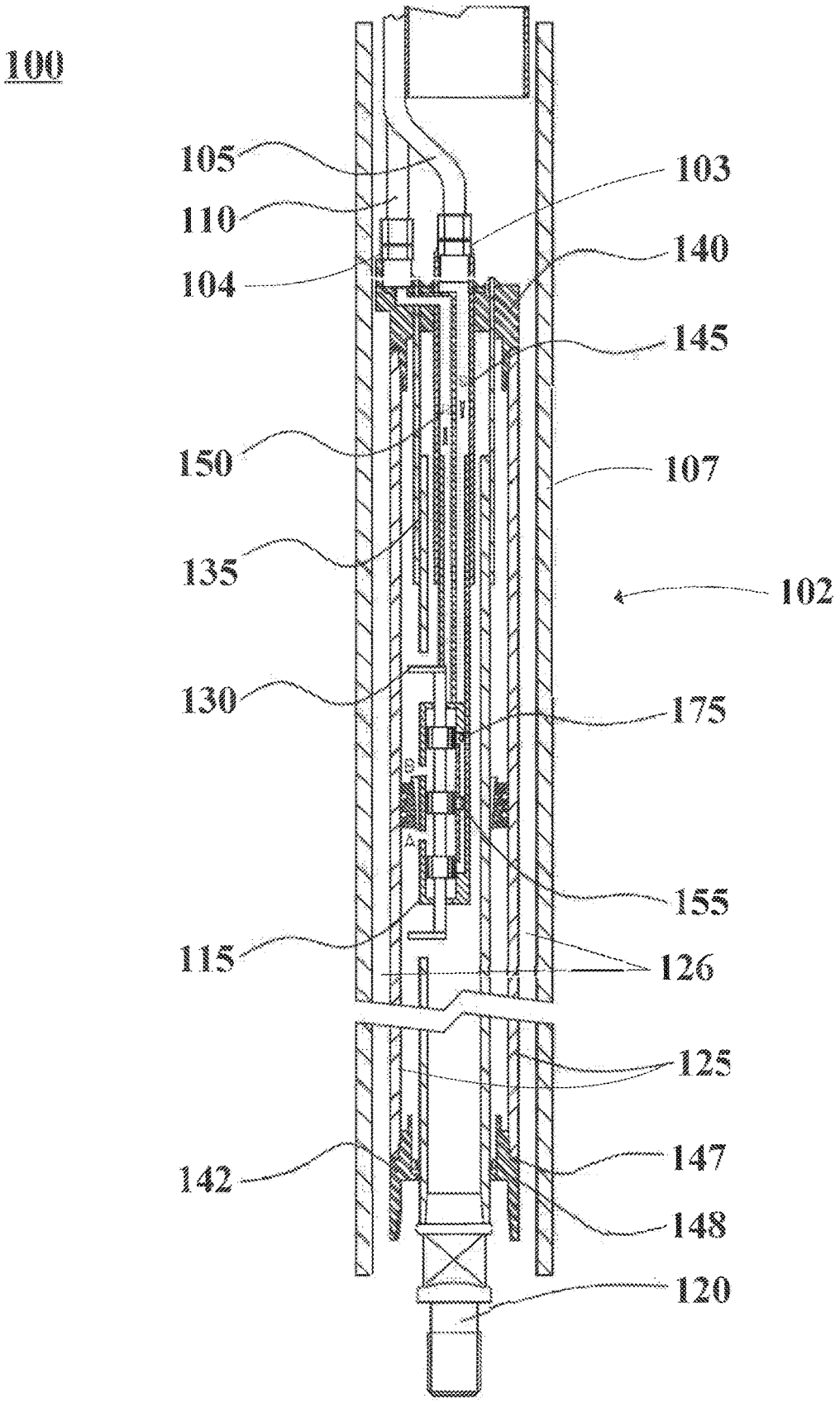
FIG. 1A depicts a partial cross-section view of a system for artificial lift including apparatus having a hydraulic downhole rodless pump actuator in accordance with embodiments.

Reference now should be made to the drawings, in which the same reference numbers are used throughout the different figures to designate the same components. It will be understood that, although the terms first, second, third, etc. may be used herein to describe various elements, these elements should not be limited by these terms. The terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure. Illustrated in the Figures are exemplary embodiments of subject matter including a system for artificial lift, apparatus, a method for artificial lift, and a production well including a system for artificial lift. Embodiments may include a downhole rodless hydraulic pump actuator connected in stroking relationship with a plunger pump. Embodiments may produce crude oil, hydrocarbons or fluids from an underground area or reservoir. One of ordinary skill will understand that embodiments may be attached and used with existing plunger pumps previously used in sucker rod wells for oil production, or pump elements of traditional design, and may replace suck rod configurations. In some embodiments, apparatus and a system for artificial lift may by integrated and self-contained, and may include a hydraulic pump actuator in combination with a plunger pump configured and assembled together in a continuous device.

FIG. 1A depicts a partial cross-section view of a system 100 for artificial lift including an apparatus having a hydraulic downhole rodless pump actuator 102 in accordance with embodiments. The system 100 may include a hydraulically operated plunger pump "actuator" 102 and may exclude a sucker rod string, as typically found on a downhole pump actuator. The primary elimination of the sucker rod allows for a lighter and more efficient system 100. Elimination of the sucker rods may also greatly reduce the horsepower requirement of the system 100, and reduce the cost of surface mounted pumping equipment and sucker rods.

Referring to FIG. 1A, in system 100, the hydraulic downhole rodless pump actuator 102 of FIG. 1A may include an inlet capillary line 105 and an outlet capillary line 110 running down hole to the pump actuator 102. The capillary lines 105,110 may be configured to provide hydraulic fluid from the hydraulic pressure equipment (not depicted) at the surface down to the spool valve 115. This design may allow for or control hydraulic fluid in the capillary lines 105,110 to always be in the same direction, so that the inlet 103 may always flow into the pump actuator 102, while the outlet 104 may always flow out of the pump actuator 102. The reversing of the actuator 102 may be accomplished via spool valve 130 contained within a plunger pump 115. As pressurized hydraulic fluid (not depicted) enters the actuator 102 from the surface thru inlet capillary line 105, the hydraulic fluid may travel through a section inside of the actuator rod 120. Actuator rod 120 may contain an inlet capillary tube 145 affixed to capillary line 105. Hydraulic fluid may eventually find its way to the spool valve 115. The hydraulic fluid may enter the plunger pump 130 through supply port (155). It is noted that components within the pump actuator 102 in conjunction with the spool valve 115 may act as pump plunger 130.

Figure 1B:
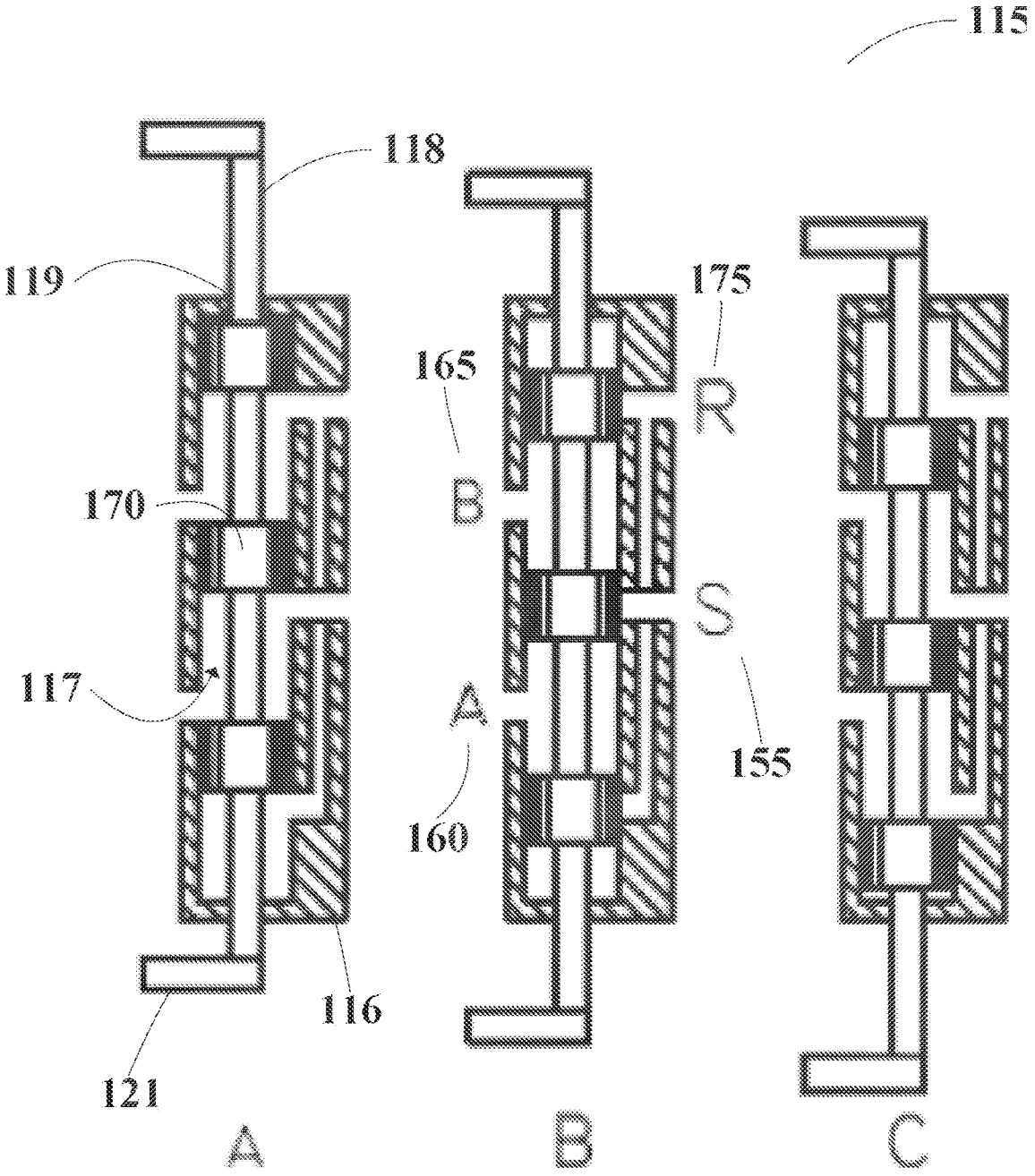
FIG. 1B displays three depictions of a plunger pump containing spool valves in embodiments of a system for artificial lift including an apparatus having a downhole rodless pump actuator.

FIG. 1B displays three depictions of a plunger pump 115. Plunger pump 115 may include spool valves (130) found within embodiments of a system for artificial lift including an apparatus having a downhole rodless pump actuator 102. In the embodiment of plunger pump 115 depicted in FIG. 1B, the hydraulic fluid may flow from supply port S 155 to outlet port A or B 160,165 depending on which way the spool valve 130 is shifted. In view A, the valve 130 is shifted in a lifting position, so the hydraulic fluid may flow under the middle piston 170, which may cause a resultant force to lift the middle piston 170 and produce hydraulic fluid from the plunger pump 115. When the tri-piston assembly 117 travels to the top of its stroke, the valve's 130 top lever 118 that protrudes out of the actuator rod 120 via a slot 119 may engage the stand-off 135 that is part of the upper cap 140. The engagement of the top lever 118 may cause the tri-piston assembly 117 to travel in the opposite (downward) direction. This may block access of the hydraulic fluid to both the return port R 175 and supply port S 155, as shown in view B. When the tri-piston assembly 117 travels further downward, the flow of hydraulic fluid may then be directed from supply port S 155 to outlet port B 165, as shown in view C. The hydraulic fluid may then be directed from the bottom of the tri-piston assembly 117 to the top of the tri-piston assembly 117 and the actuator rod 120 is then pushed down causing the plunger pump 115 to reload. It is noted that in both instances where the supply port S 155 is open (view A and view B), the hydraulic fluid being displaced by the middle piston 170 may be returned to return port R 175 on the plunger pump 115 and sent to the surface via the outlet capillary tube 150, as shown in FIG. 1.

Production fluid flowing from the plunger pump 115 may flow to the surface through the annular area 126 surrounding actuator housing 125 inside of the well casing 107. Both the upper and lower caps 140,142 may comprise 0-ring seals 147 on the actuator housing 125 and pressure and wiper seals 148 on the actuator rod 120. The ability of the directional control valve to function properly may be dependent upon the sliding of the actuator rod 120 within the pump actuator 102 in order to allow for the top and bottom levers 118,121 of the spool valve 115 to come in contact with the upper and lower caps 140,142. This contact may shift the valve 115 at the end of its stroke, as shown in FIG. 1A.

Referring to FIG. 1B, in embodiments, the spool valve 115 may comprise a housing, a tri-piston assembly 117, at least two ports (such as, but not limited to outlet ports A and B 160,165, supply port S 155, and return port R 175, and at least two levers (top and bottom levers 118,121). In embodiments, the spool valve may be affixed to a portion of the interior surface of the actuator rod.

Figure 2:
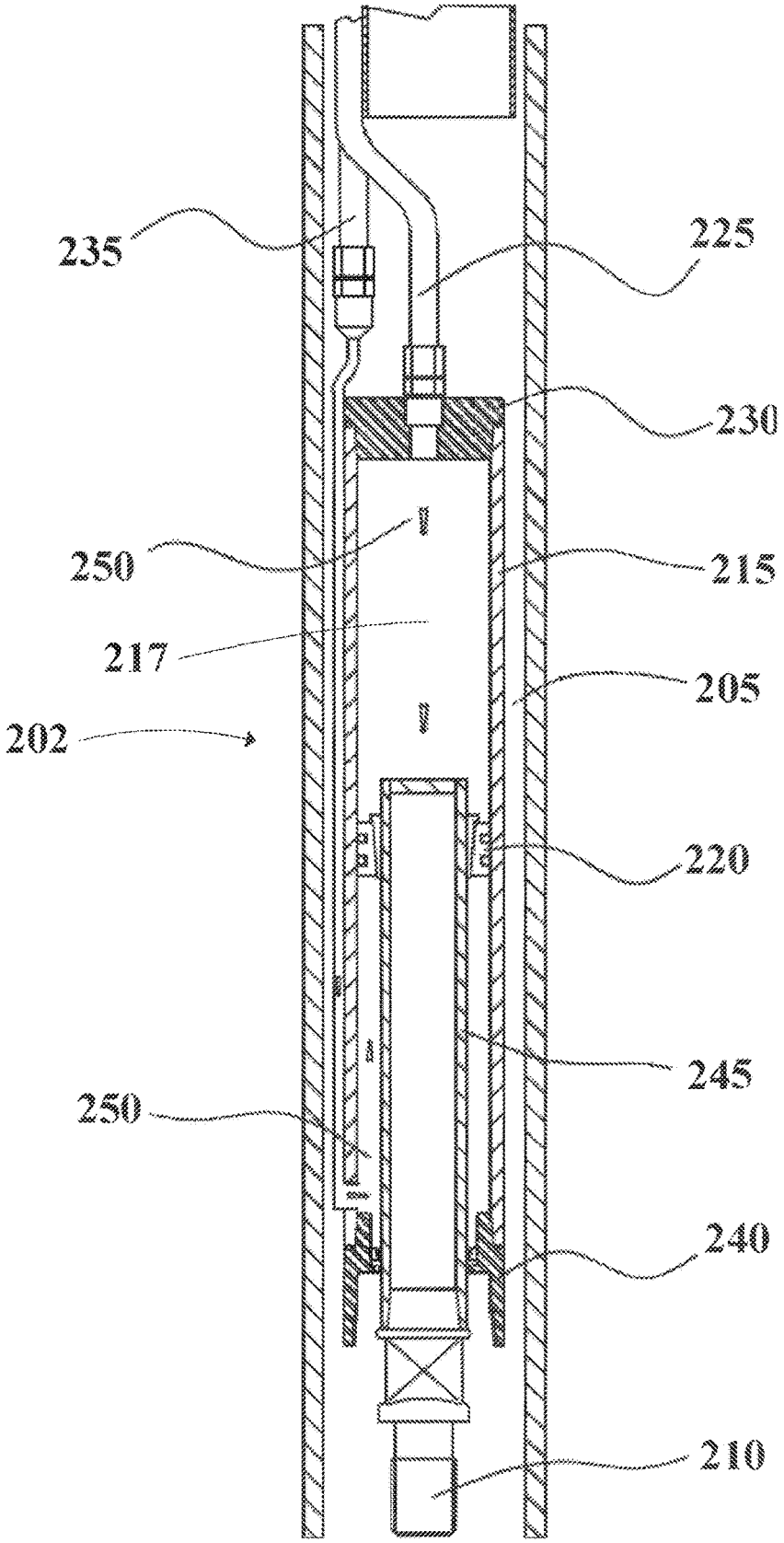
FIG. 2 depicts a partial cross-section view of a system for artificial lift including apparatus having a hydraulic downhole rodless pump actuator in accordance with embodiments.

FIG. 2 depicts a partial cross-section view of a hydraulic downhole rodless pump actuator 202 in a system 200 for artificial lift in accordance with embodiments. This embodiment may include a directional control valve (not depicted) as part of the surface equipment. In the embodiment, the pressure spike obtained from the bottoming out of the hydraulic cylinder 205 (including an actuator rod 210 and actuator housing 215) may be read at the top of at least one of the inlet capillary tube 225 and the adjacent capillary tube 235, and the directional control valve may be shifted. The hydraulic fluid 250 (depicted with arrows) may travel thru the inlet capillary tube 225 and may enter the upper cap 230. The hydraulic fluid 250 may flow into the actuator housing 215 and may create pressure inside the cylinder space 217 of the actuator housing 215, which may result in a force on the area equal to the actuator rod 210 and the piston assembly 220. This force may push the actuator rod 210 down to the bottom of the actuator housing 215 and cause the attached plunger pump cylinder 245 to reload. At this point, the surface mounted directional control valve may shift and the flow may reverse so that the fluid 250 may now enter the adjacent capillary tube 235. This may cause the force created by the resultant pressure to be exerted on the bottom side of the piston 220 and the top of the bottom cap 240 that may raise the actuator rod 210 attached to the plunger pump cylinder 245. The oscillating of the actuator rod 210 may run the plunger pump 205 so that production fluid 250 may be produced in the annular area surrounding the actuator rod 210 and up into the production tubing. It is noted that, in embodiments, the hydraulic cylinder 205 and its components may be utilized as a plunger pump.

Regarding FIG. 2, in embodiments, the adjacent capillary tube 235 may be affixed to at least a portion of the hydraulic cylinder 205 throughout the period of upward and downward movement of the plunger pump cylinder 245. This may be due to additional length in the adjacent capillary tube 235 or the capability of for the adjacent capillary tube 235 to expand and retract.

Figure 3:
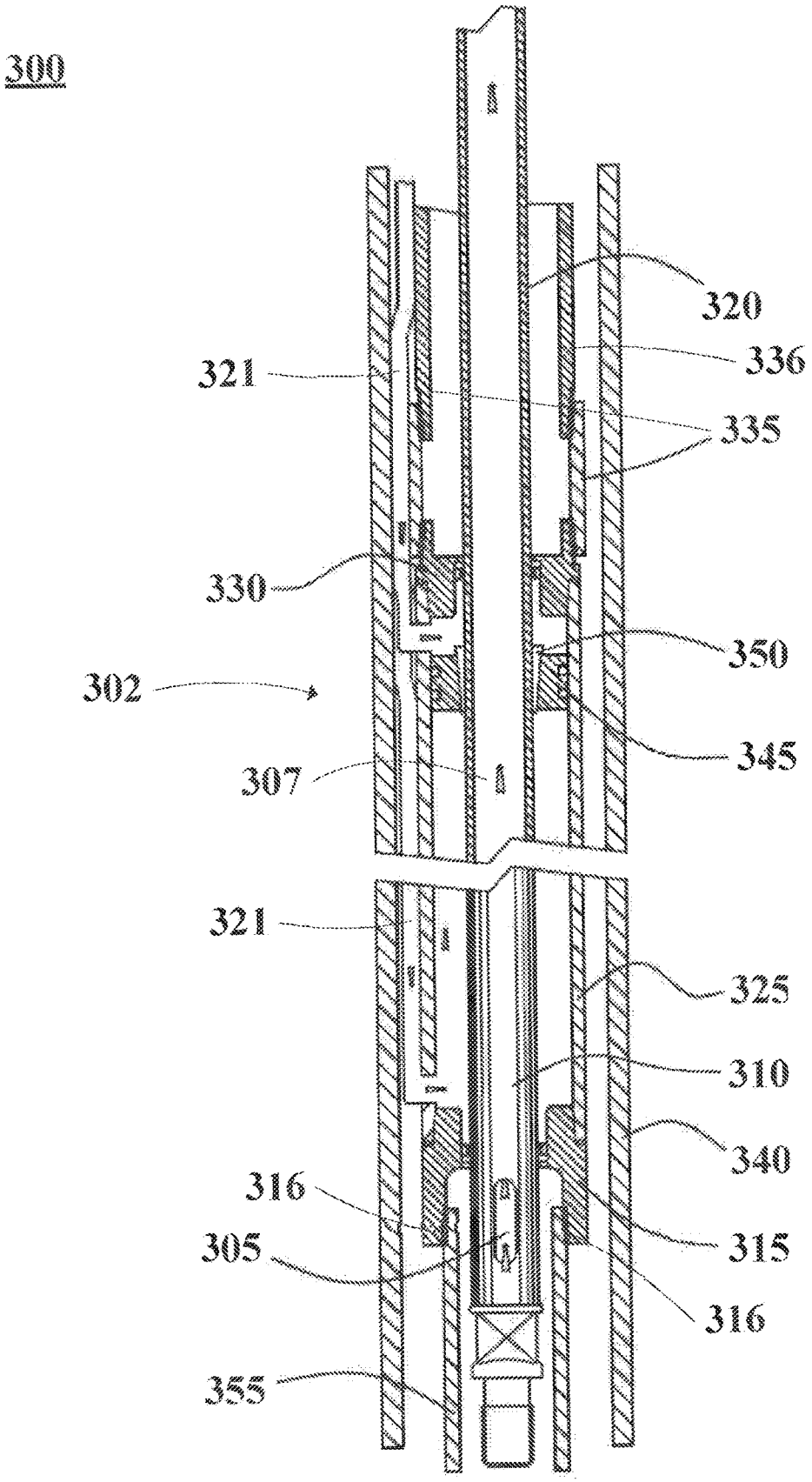
FIG. 3 depicts a partial cross-section view of a system for artificial lift including apparatus having a hydraulic downhole rodless pump actuator in accordance with embodiments.

FIG. 3 depicts a partial cross-section view of a hydraulic downhole rodless pump actuator 302 in a system 300 for artificial lift in accordance with embodiments. The embodiment of FIG. 3 may be thought of as a structurally more complex actuator 302 than the embodiment of the actuator 202 found in FIG. 2. The production fluid 307 (depicted with arrows) found in this embodiment may flow into an opening (305) in the actuator rod 310. The production fluid 307 may then be injected directly into the actuator tubing 325. The actuator tubing 325 may be attached directly to the lower cap 315 and the produced fluid may flow thru the hollow actuator rod 320 found within the actuator tubing 325. Capillary tubes 321 may be attached to the actuator tubing 325 just adjacent to the lower cap 315 and the upper cap 330. The pump actuator 302 may attach directly to production tubing 336 via a standard coupling 335. The pump actuator 302 may further include well casing 340. The force from the hydraulic pressure may be applied to the bottom of the piston 345 when the pump actuator 302 is in the raising mode. This may cause the piston wedge 350 to tighten its grip upon the actuator rod 310. A lower actuator tubing 355 may surround the actuator rod 310 and may be affixed to a bottom portion 316 of the lower cap 315.

Figure 4A:
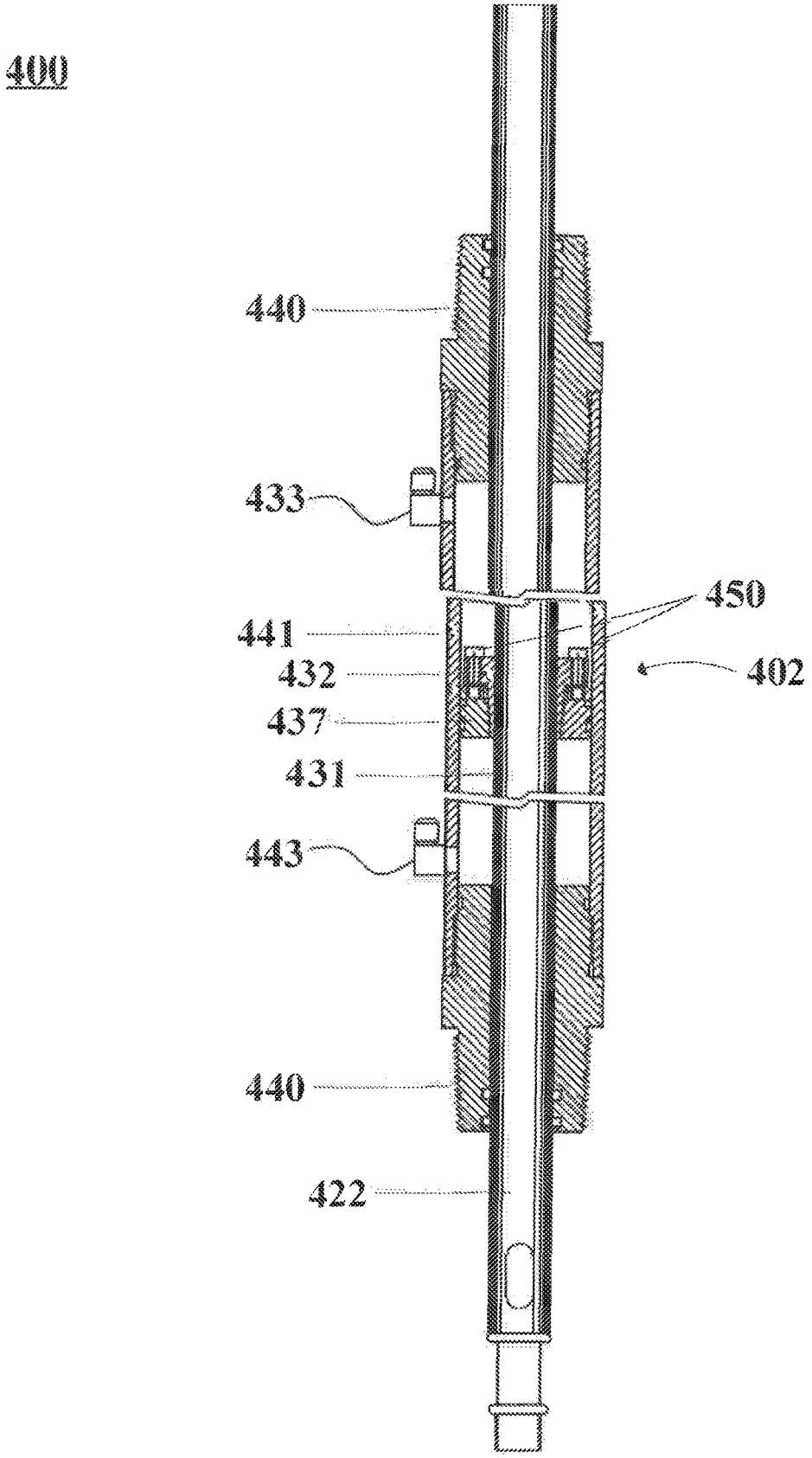
FIG. 4A depicts a partial cross-section view of a system for artificial lift including apparatus having a hydraulic downhole rodless pump actuator in accordance with embodiments.
Figure 4B:
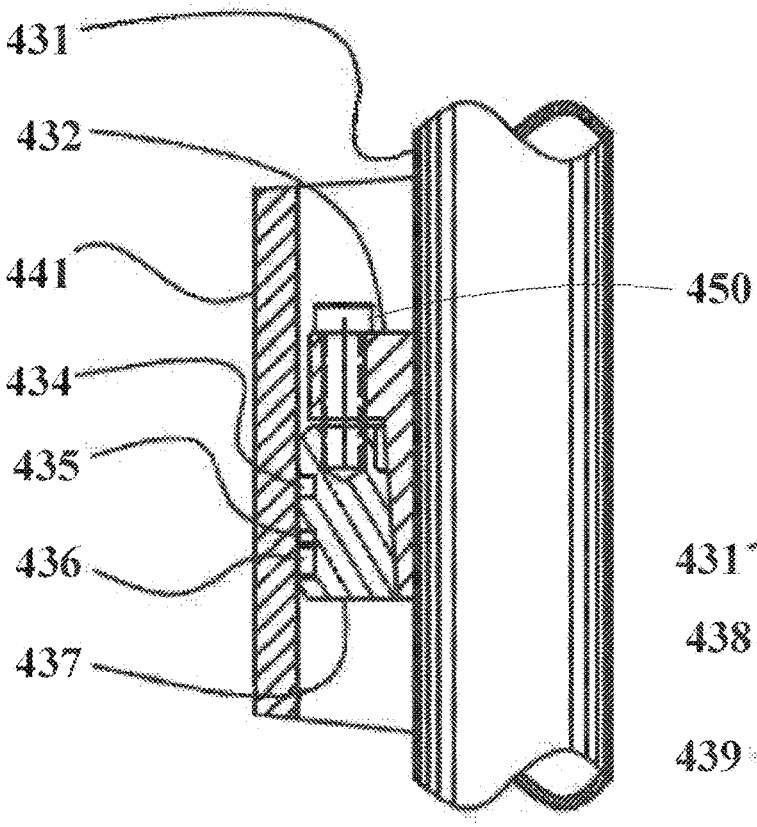
FIG. 4B depicts an enlarged view of a section of an actuator rod and its engagement to a piston in a system for artificial lift including apparatus having a downhole rodless pump actuator in accordance with embodiments.
Figure 4C:
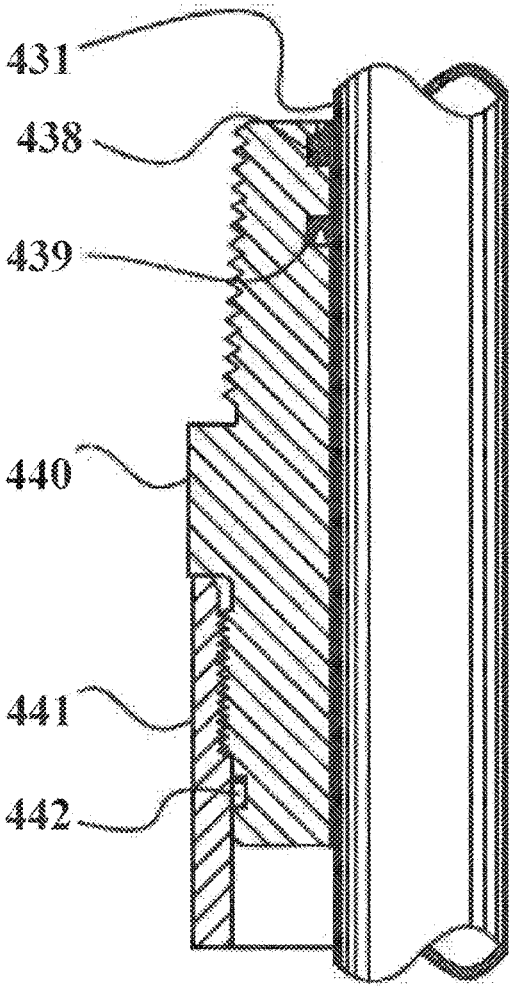
FIG. 4C depicts an enlarged view of an end cap in engagement with an actuator housing in a system for artificial lift including apparatus having a downhole rodless pump actuator in accordance with embodiments.

FIG. 4A depicts a partial cross-section view of a hydraulic downhole rodless pump actuator 402 in a system 400 for artificial lift in accordance with embodiments. The embodiment found in FIG. 4A may be a simplified embodiment that may include the actuator housing 441, actuator rod 431, symmetrical end caps 440, piston 437, and piston wedge 432. The piston wedge may be held in place by one or more bolts 450 which may initiate the compression and resultant clamping force on the actuator rod 431. Seals 434,436 on the piston 437 may include a pressure seal 436 with a back-up ring 435 and a wiper seal 434, as shown in detail in FIG. 4B. Pressure against the lower or bottom face of the piston 437 may raise the piston 437 and may also tighten the piston wedge 432, which may re-enforce the piston 437 lift capacity. The end caps 440 may be symmetrical and may contain a wiper seal 438, FIG. 4C.

The hydraulic fluid (not depicted) for the actuation of the actuator rod 422 may enter and exit the actuator via 90 degree hydraulic fittings 433,443 welded to the actuator housing 441. The 90 degree hydraulic fittings 433,443 may be attached to standard hydraulic connections (not depicted) located at the end of capillary tubes (not depicted). The operation of the actuator rod 422 in this embodiment may be carried out via the reversing of the flow of the hydraulic fluid from the surface thru a directional control valve (not depicted). The actuator rod 422 may be connected directly to production tubing (not depicted) on the top and a plunger pump (pump actuator 402 minus the actuator rod 422) on the bottom. As with other embodiments, the hydraulic fluid (not depicted) produced by the plunger pump may be flowed through the hollow actuator rod 422 directly into the production tubing. The actuator rod 422 may stroke up into the production tubing during its upstroke. In embodiments, the piston wedge 432 may be held in place by three bolts 450.

Figure 5A:
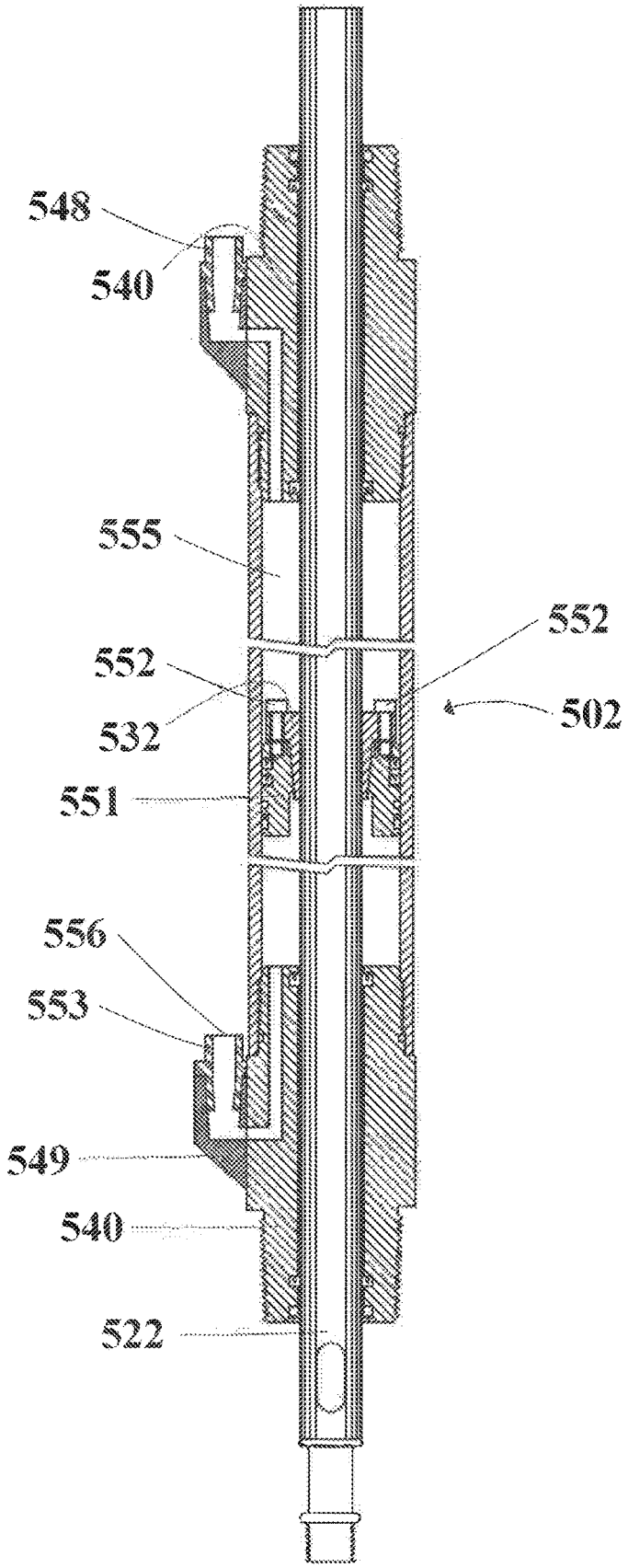
FIG. 5A depicts a partial cross-sectional view of a hydraulic downhole rodless pump actuator in a system for artificial lift including apparatus having a downhole rodless pump actuator in accordance with embodiments.

FIG. 5A depicts a partial cross-section view of a hydraulic downhole rodless pump actuator 502 in a system 500 for artificial lift in accordance with embodiments. In this embodiment, the pump actuator 502 may be powered on the down stroke by a charge of nitrogen gas (not depicted) which may act as a gas spring from the accumulator effect of having a compressed gas above the piston 551. In the assembly, the piston 551 may be attached to actuator rod 522 via the piston wedge 532 and is retained via a set of bolts 552 and the compression of the hydraulic pressure against the bottom lifting force of the piston 551. The piston 551 may retain a pressure seal 546, a back-up ring 545, and a wiper seal 544, as shown in detail in FIG. 5B.

Figure 5B:
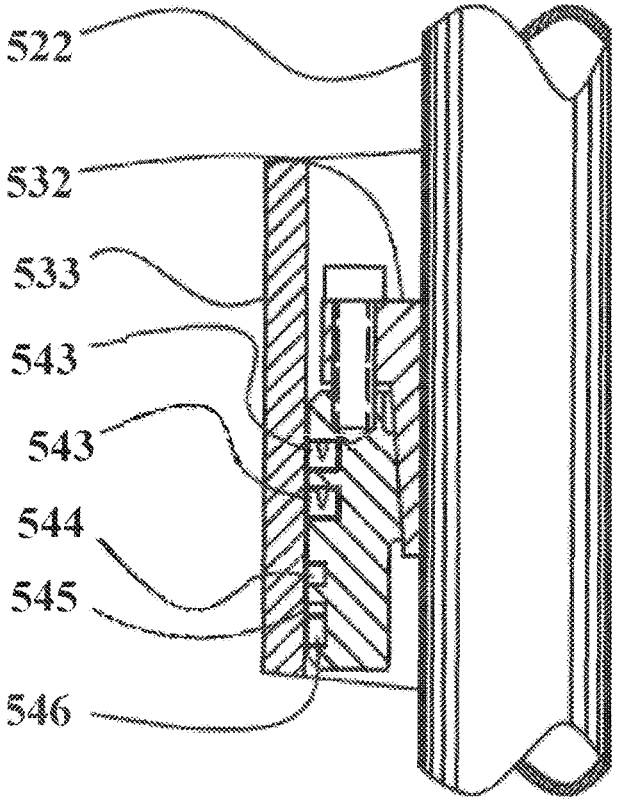
FIG. 5B depicts an enlarged view of a section of an actuator rod and its engagement to a piston in a system for artificial lift including apparatus having a downhole rodless pump actuator in accordance with embodiments.
Figure 5C:
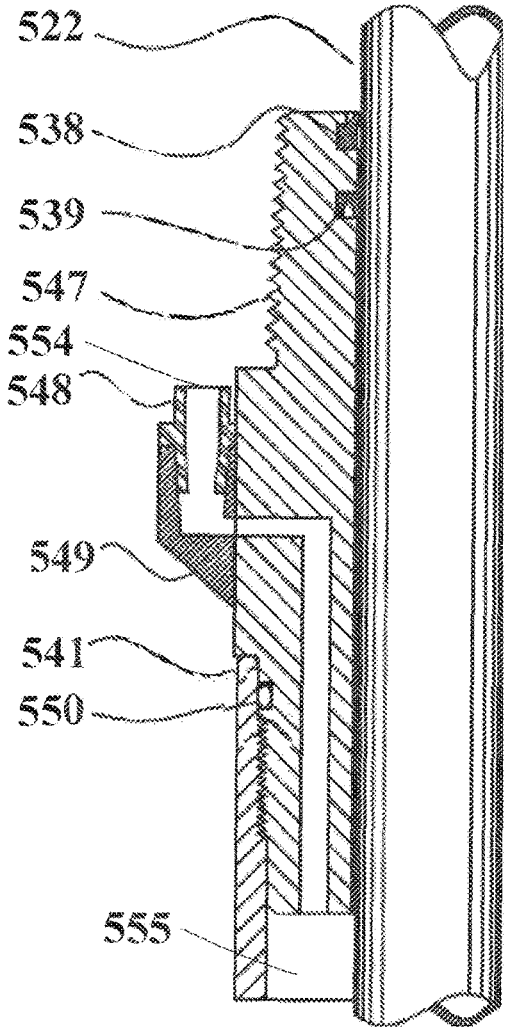
FIG. 5C depicts an enlarged view of an endcap in engagement with an actuator housing in a system for artificial lift including apparatus having a downhole rodless pump actuator in accordance with embodiments.

The piston 551 may include two chevron gas seals 543 facing up so as to be expanded by the nitrogen gas, as shown in detail in FIG. 5B. The end caps 540 of the pump actuator 502 may be symmetrical with the exception that the capillary connection blocks 549 may be reversed so that they may both point in the up-hole direction, similar to the embodiments found in FIG. 1 and FIG. 3. The blocks 549 (as shown in FIG. 5C) may be welded onto the end caps 540 prior to assembly of the pump actuator 502. The capillary ends 547 may contain a wiper seal 538, pressure seals an O-ring pressure seal 550, and a port 554 drilled for the insertion of the nitrogen gas and the inlet 548 and outlet 553 (FIG. 5A) of the hydraulic fluid (FIG. 5C). The nitrogen gas at a raised pressure may be inserted into the upper chamber 555 of the pump actuator 502 via the capillary connection block 549 welded to the upper cap 540. The block 549 may be open to the tapered thread end of the end cap 540 so as to allow easy connection of a capillary tube (not depicted). This may result in a gas shock/spring on the top of the piston 551 that may push the piston 551 down, refilling the plunger pump (pump actuator 502 minus the actuator rod 522) on the down stroke. The lower cap 540 may have the capillary block 549 welded on with the opening 556 pointing toward the straight threaded end. Opening 556 may be the port through which the hydraulic fluid may be pumped into in order to raise the piston 551 and may also be used to allow the hydraulic fluid to be returned to the surface. As in other embodiments, the production fluid (not depicted) produced by the plunger pump may be flowed through the hollow actuator rod 522 directly into production tubing (not depicted). The actuator rod 522 may stroke up into the production tubing during its upstroke.

Figure 6A:
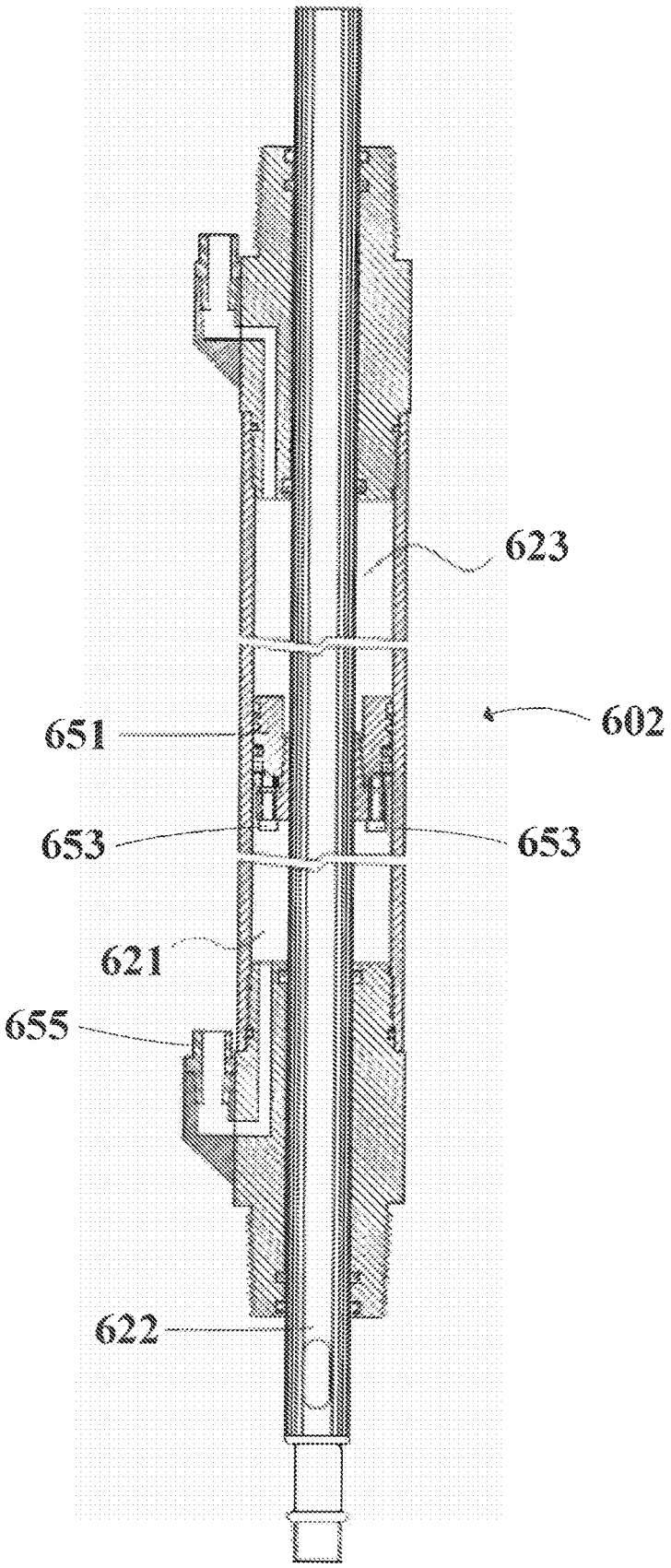
FIG. 6A depicts a partial cross-section view of a hydraulic downhole rodless pump actuator in a system for artificial lift including apparatus having a downhole rodless pump actuator in accordance with embodiments.

FIG. 6A depicts a partial cross-section view of a hydraulic downhole rodless pump actuator 602 in a system 600 for artificial lift in accordance with embodiments. In this embodiment, the location of gas space 621 may be reversed when compared to other embodiments. The gas space 621 may provide for nitrogen gas to be injected into and contained in the gas space 621 at the bottom of the pump actuator 602 with the power on the up stroke being provided by the gas pressure acting upon the bottom face area of the piston 651. Gas space 621 may be sealed at the end of the above ground capillary tube (not depicted) and may act as a type of gas spring. As a result, the actuator rod 622 may then be lifted and the plunger pump (pump actuator 602 minus the actuator rod 622) may be made to deliver production fluid (not depicted) to the surface as shown in FIG. 1. In this instance, the actuator rod 622 may be hollow and the production fluid may flow through the actuator rod 622 and into the production tubing. Once the actuator rod (622) is in the position, hydraulic fluid 623 may be sent to the actuator upper chamber 623 located at the top of the pump actuator 602 and there it acts upon the top face area of the piston 651, driving the actuator rod 622 down. At the end of its stroke, the actuator rod 622 may stop and an above ground valve (not depicted) may open and may allow the hydraulic fluid 623 to travel back out of the actuator upper chamber 623 and through inlet 648 attached at the upper cap 647 at the weld cap 649 as shown in FIG. 6B.

Figure 6B:
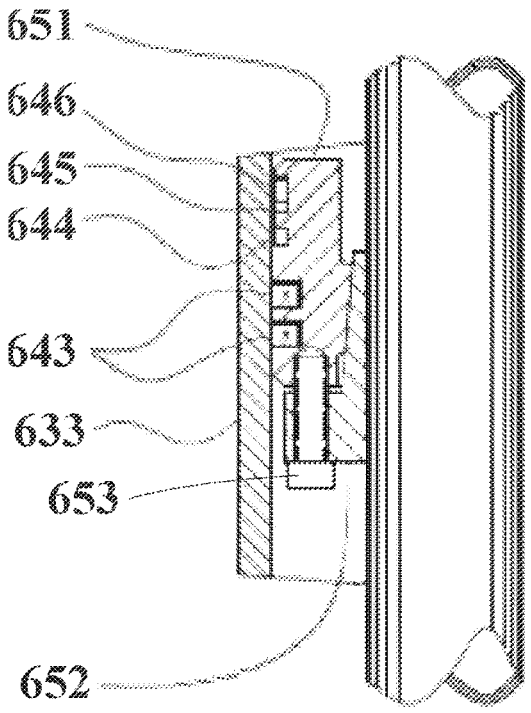
FIG. 6B depicts an enlarged view of a section of an actuator rod and its engagement to a piston in a system for artificial lift including apparatus having a downhole rodless pump actuator in accordance with embodiments.
Figure 6C:
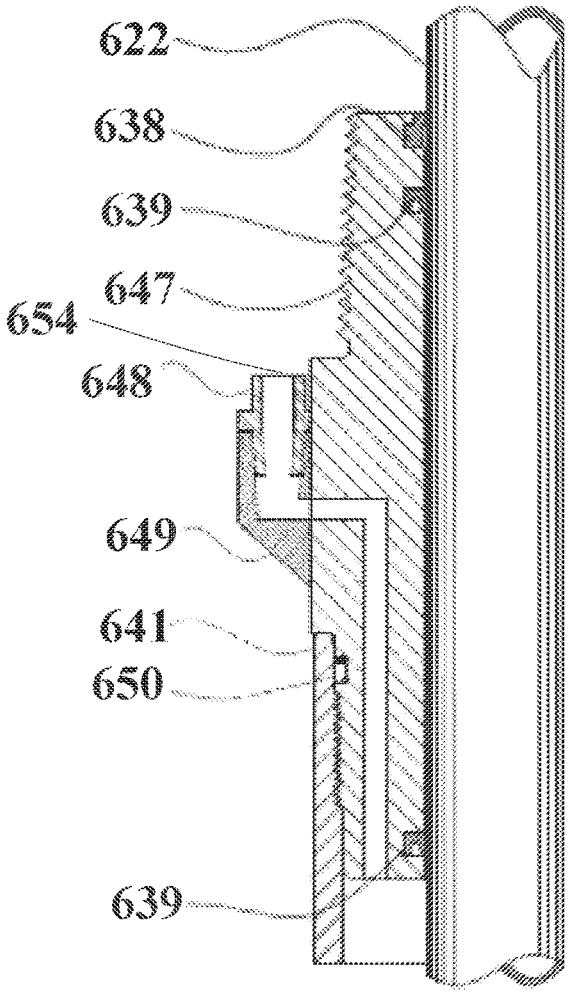
FIG. 6C depicts an enlarged view of an endcap in engagement with an actuator housing in a system for artificial lift including apparatus having a downhole rodless pump actuator in accordance with embodiments.

As before, the piston 651 may be sealed to the hydraulic side of the pump actuator 602 via a piston seal 646, a back-up ring 645, and a wiper seal 644 (FIG. 6B). Added to the piston 651 may be two chevron gas seals 643 that may face up so as to be expanded by the nitrogen gas (FIG. 6B). In the assembly, the piston 651 may again be attached to actuator rod 631 via the piston wedge 652 and may be retained via a set of bolts 653 and the compression of the nitrogen gas pressure against the face of the piston 651. The end caps 647 of the actuator housing 633 may contain a wiper seal 638, pressure seals 639, an O-ring pressure seal 650, and a port 654 drilled for the insertion of the nitrogen gas into gas space 621 and the inlet 648 and outlet 655 of the hydraulic fluid 648 (FIG. 6C). As with other embodiments, the production fluid (not depicted) produced by the plunger pump may be flowed through the hollow actuator rod 631 directly into the production tubing (not depicted). The actuator rod 631 may stroke up into the production tubing during its upstroke.

Figure 7A:
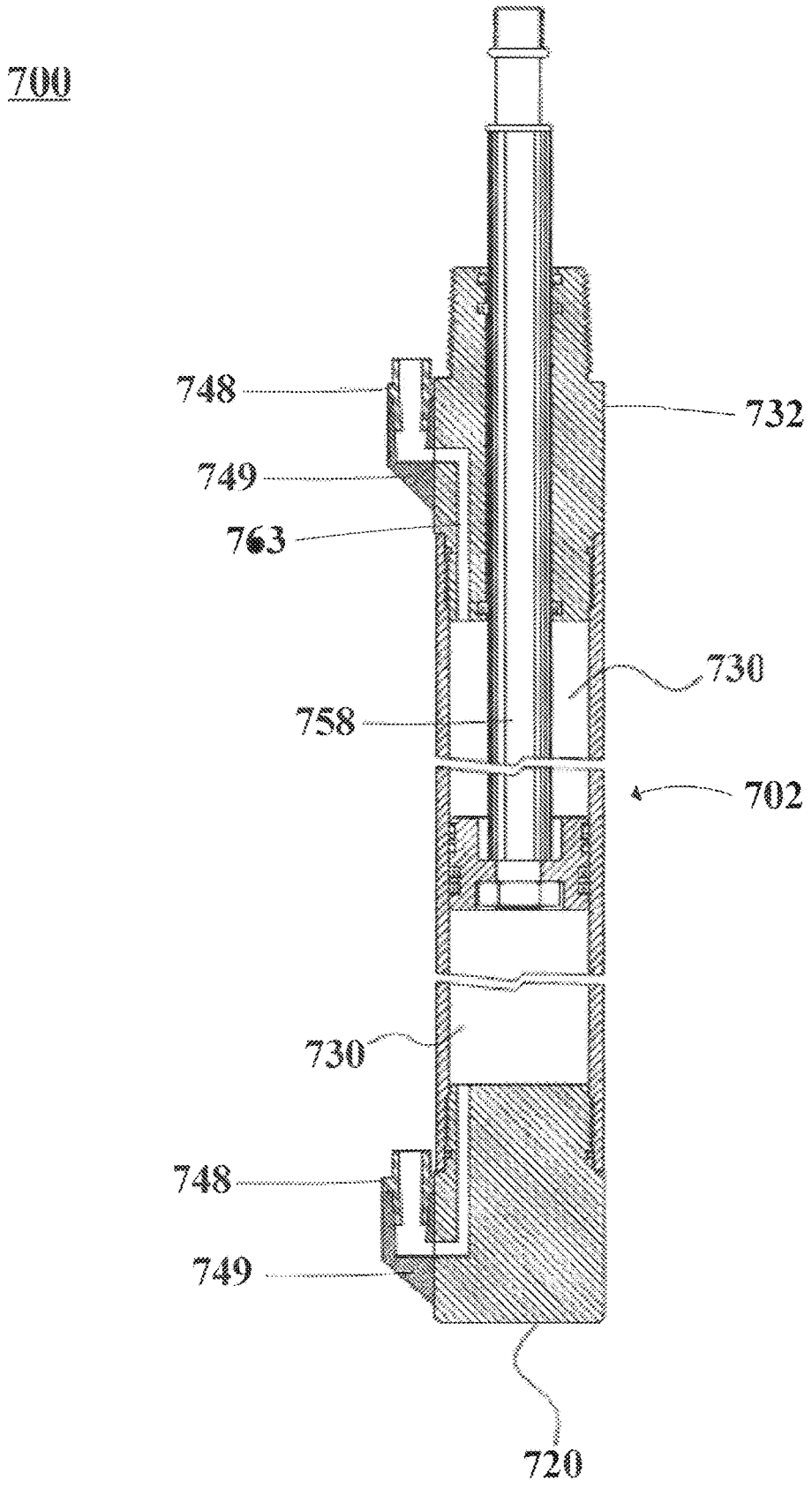
FIG. 7A depicts a partial cross-section view of a hydraulic downhole rodless pump actuator in a system for artificial lift including apparatus having a downhole rodless pump actuator in accordance with embodiments.

FIG. 7A depicts a partial cross-section view of a hydraulic downhole rodless pump actuator 702 in a system 700 for artificial lift. In this embodiment, the configuration of the pump actuator 702 may be reversed with the plunger pump (pump actuator 702 minus actuator rod 758) reversed within the pump actuator 702 in the well. The actuator rod 758, in this configuration may exit the pump actuator 702 only on the top and may extend into the bottom of the pump actuator 702 and may connect to the plunger pump. The plunger pump may be stroked to the full capacity of the plunger's stroke within the pump actuator 702.

As shown in FIG. 7A, the lower chamber 730 of the pump actuator 702 may be filled via its capillary connection 748 which is mounted at its welded mount 749 to the upper end cap 732 and the lower end cap 720. The upper end cap 732 may have a capillary fitting 763 which may connect the upper chamber to the hydraulic circuit (not depicted) supplied from an above ground hydraulic power source (not depicted). This hydraulic power source may be used to power the hydraulic fluid (not depicted) which may drive the piston 753 down and in turn may cause the refilling of the plunger pump. The upper cap may have seals that may seal off the vertical actuator shaft 758 at the wiper seal 738 and the pressure seal 739. Also present may be a pressure seal 750 at the bottom of the upper end cap 732. In embodiments, the actuator housing 754 may comprise a top end 741 that may be configured to receive at least a portion of the upper end cap 732. In embodiments, the upper end cap 732 may comprise a threaded portion 747 that may be utilized to affix the upper end cap 732 to another portion of a hydraulic pump.

Figure 7B:
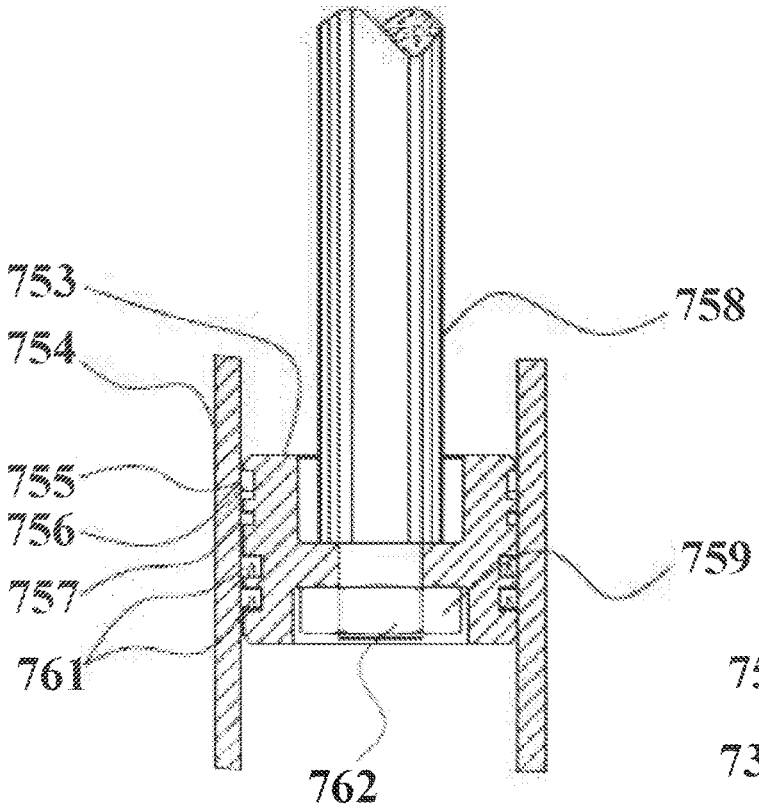
FIG. 7B depicts an enlarged view of a section of an actuator rod and its engagement to a piston in a system for artificial lift including apparatus having a downhole rodless pump actuator in accordance with embodiments.

FIG. 7B depicts an enlarged view of a section of an actuator rod 758 and its engagement to a piston 753 in a system 700 for artificial lift. The bottom cap 720, in embodiments, may have a center port (not depicted) through which the actuator rod 758 may pass. Instead, the actuator rod 758 may end at the piston 753 and may be in compression loading while stroking the plunger pump. The piston 753 may be attached to the actuator rod 758 via a nut 762. The actuator rod 758 in this application may be solid and threaded to accept the piston 753 and retaining nut 762 mounted on the bottom end. The actuator rod 758 may be fitted with an API sucker coupling connection (not depicted) on the top end. The piston 753 may travel vertically through the actuator housing 754 and seal at the top against the hydraulic pressure with a piston seal 755 and a back-up ring 756. The gas pressure side of the piston 753 may be sealed via two chevron gas rings 761. In embodiments, additional piston seals 755,757 may be utilized by piston 753.

Figure 7C:
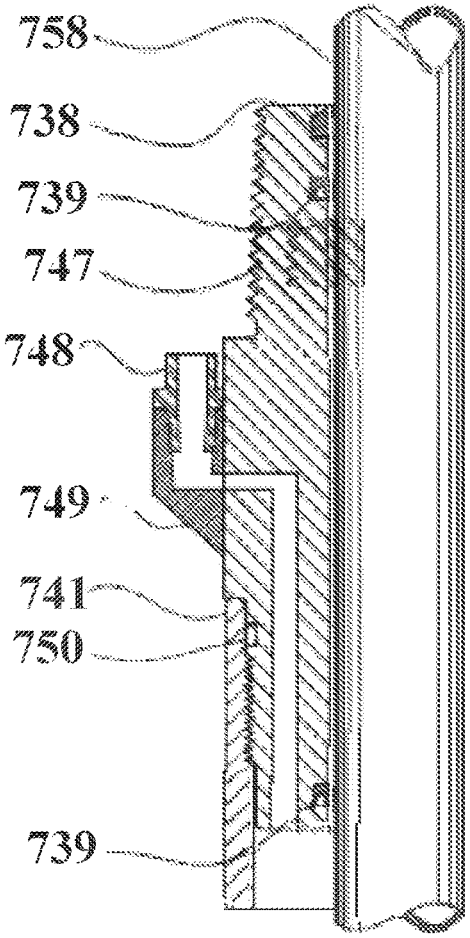
FIG. 7C depicts an enlarged view of an end cap engagement with an actuator housing in a system for artificial lift including apparatus having a downhole rodless pump actuator in accordance with embodiments.

The gas pressure supplied through the lower cap capillary connection 748 may exert its pressure against the surface area of the bottom face of the piston 753, the lower cap capillary connection 748 shown in FIG. 7C. The force supplied by the gas pressure in this chamber may raise the piston 753 and hence the plunger pump may be stroked. When the piston has completed its travel, the hydraulic pressure created by the hydraulic fluid not depicted entering the upper chamber 730 may return the piston 753 to the bottom of the pump actuator 702 and may refill the plunger pump, completing the pumping cycle.

Figure 8:
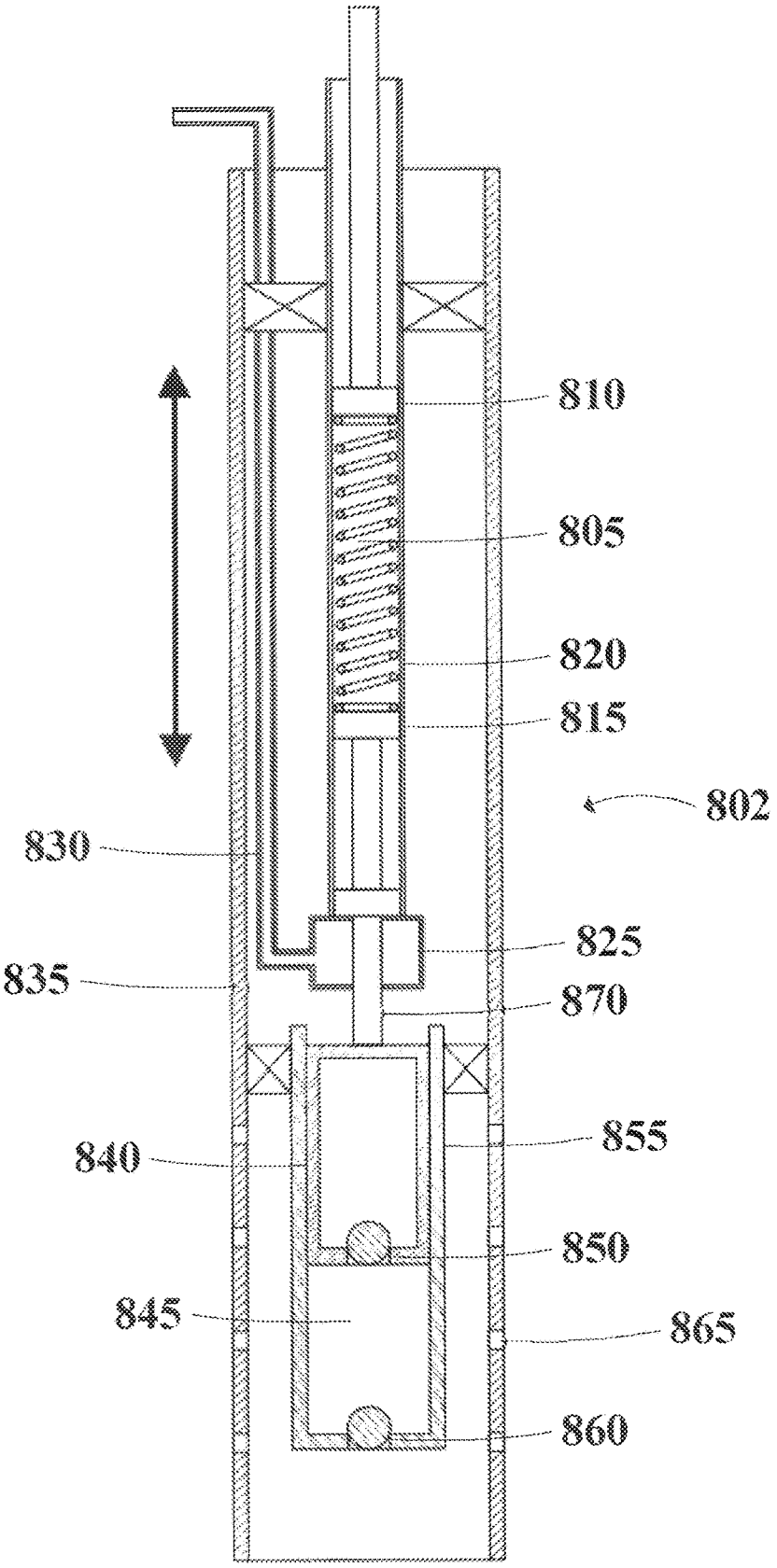
FIG. 8 depicts a partial cross-section view of a hydraulic downhole rodless pump actuator in a system for artificial lift including an apparatus having a downhole rodless pump actuator in accordance with embodiments.

FIG. 8 depicts a partial cross-section view of a hydraulic downhole rodless pump actuator 802 in a system 800 for artificial lift in accordance with embodiments. In embodiments, the pump actuator 802 may comprise a spring mechanism 805 secured between two pistons (top and bottom pistons) 810,815 housed within a return spring chamber 820. Adjacent the bottom of the return spring chamber 820 may be a first transfer chamber 825. The pump actuator 802 may further comprise a pump line 830 that may be affixed to the first transfer chamber 825 and may run adjacent the return spring chamber 820 within the casing 835.

Referring to FIG. 8, the pump actuator 802 may further comprise a traveling valve apparatus 840. The traveling valve apparatus 840 may comprise a second transfer chamber 845, including a traveling valve 850 that may be affixed to a hollow rod 870 attached to the bottom piston 815 (the piston may run through perforations in the first transfer chamber 825). The traveling valve apparatus 840 may further comprise a valve housing 855 that may encapsulate the second transfer chamber 845 and may also comprise a stationary valve 860 found at the bottom interior of the valve housing. At least one seal (not depicted) may sealably engage the periphery of the valve housing 855 as well as the interior surface of the casing 835 in order to provide an airtight and water tight barrier that may prevent leakage of hydraulic fluid and/or hydrocarbons or natural gas. A plurality of perforations 865 may exist around the periphery of the casing 835 in proximity to the traveling valve apparatus 840 in order to give the traveling valve apparatus 840 access to production fluid (not depicted).

Referring to FIG. 8, when the spring 805 is actuated via power supplied from a hydraulic power source (not depicted) at the surface of a well and pushed upward, the second transfer chamber 845 may be pulled upward, causing the traveling valve 850 to close and the stationary valve 860 to open and hydrocarbons to flow upward with the second transfer chamber 845. In embodiments, the hydrocarbons may flow directly from the second transfer chamber 845 to the first transfer chamber 825. In embodiments, the hydrocarbons may flow directly from the second transfer chamber 845 into the hollow rod 870 via a portion of the bottom piston 815. In order to carry out the flow of hydrocarbons, the hollow rod 870 may allow flow through the embodiment and above into production tubing not depicted that continues up the wall to the surface.

Referring to FIG. 8, when the spring 805 is actuated in a downward manner, the second transfer chamber 845 may be forced in a downward direction, causing the traveling valve 850 to open and allow hydrocarbons to flow into the second transfer chamber 845 while simultaneously closing the stationary valve 860.

Referring to FIG. 8, in embodiments, a centralizer may be affixed to the exterior surface of the casing 835. In embodiments, the centralizer may center the casing 835 when in a wellbore.

Figure 9A:
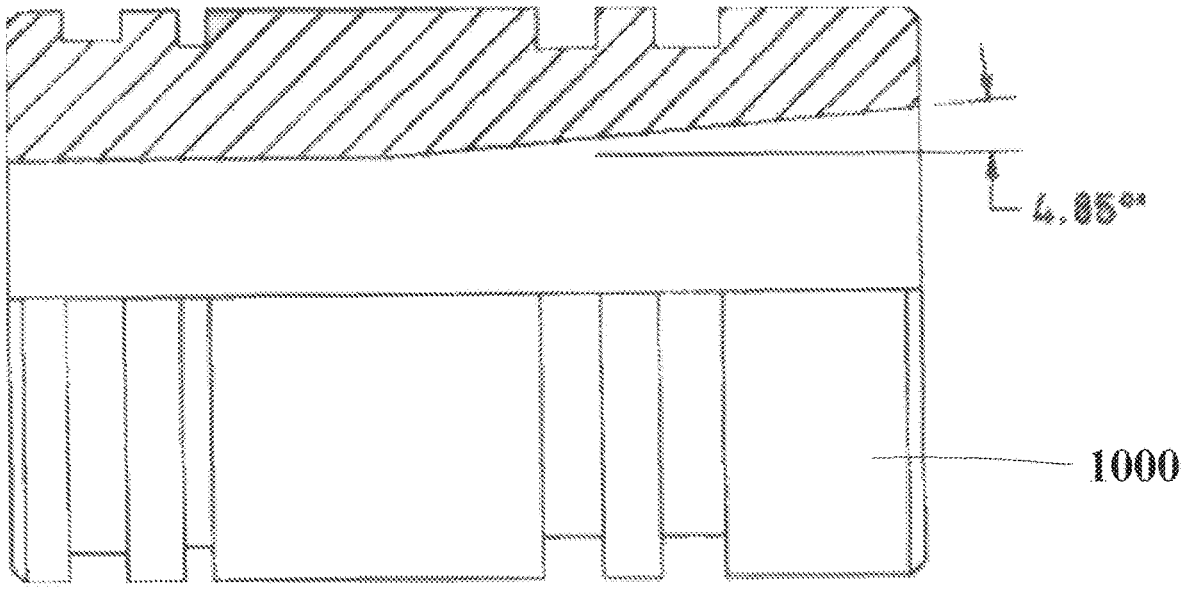
FIG. 9A depicts a partial cross-sectional view of a piston in accordance with embodiments.
Figure 9B:
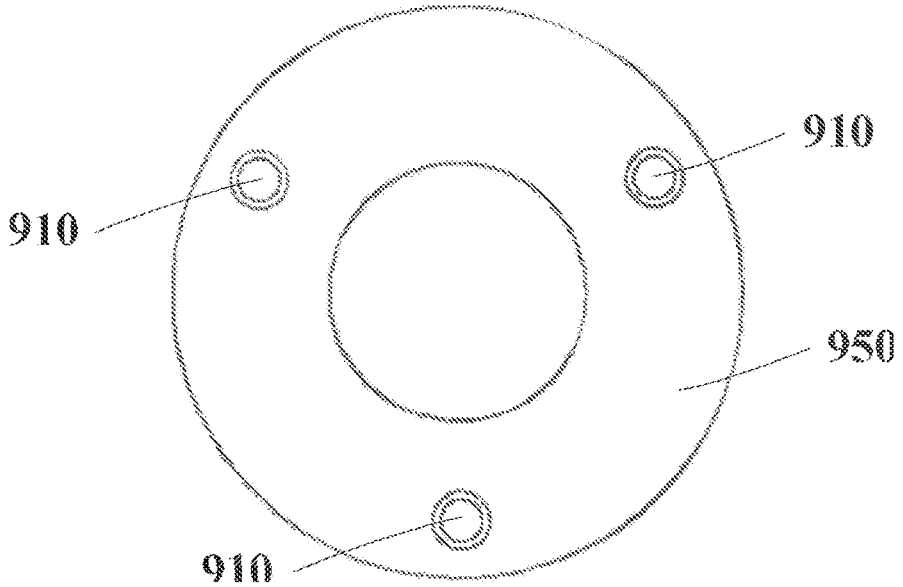
FIG. 9B depicts an enlarged top view of a piston wedge for receiving bolts (not shown) and usable with a piston as shown generally in FIG. 9A in downhole rodless pump actuators in accordance with embodiments.
Figure 10A:
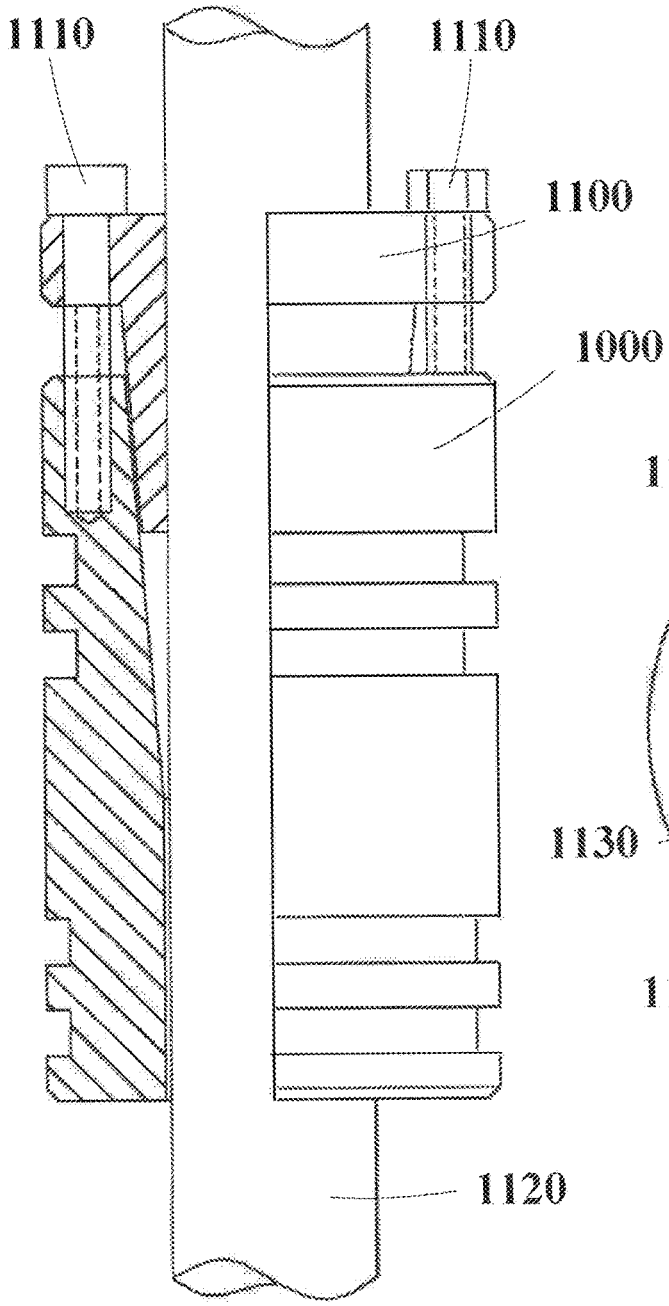
FIG. 10A depicts an enlarged view of a section of an actuator rod and its engagement to a piston in a system for artificial lift including apparatus having a downhole rodless pump actuator in accordance with embodiments.
Figure 10B:
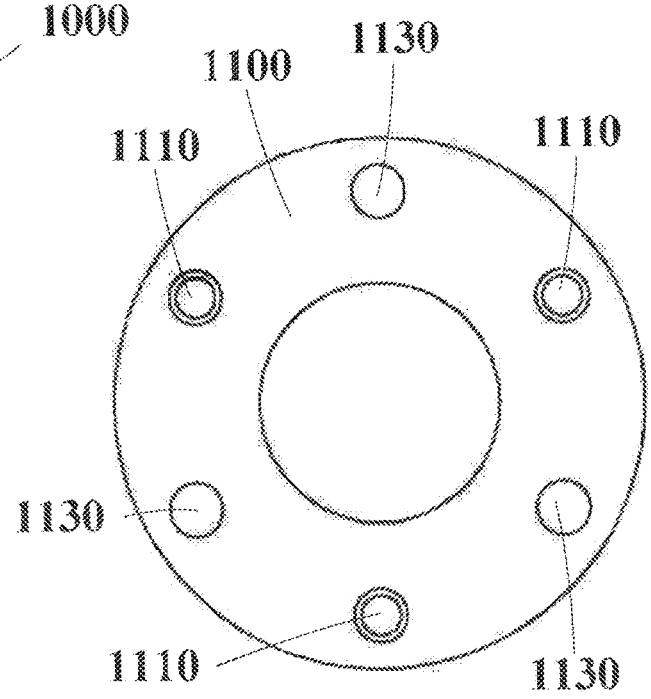
FIG. 10B depicts a top view of a piston wedge shown generally in FIG. 10A, with bolts omitted, in accordance with embodiments.

FIG. 9A depicts a partial cross-sectional view of a piston 1000 in accordance with embodiments. In embodiments, a portion of the interior of the piston 1000 may be hollowed out in a truncated cone shape. The cone shape may increase in diameter until the cone shape meets an edge of the piston 1000. The angle at which the cone shape expands may be, for example, 4.85 degrees. The cone shape may allow a piston wedge 1100 (FIG. 10A) to properly slide and fit at least partially within the piston. A further view of an embodiment of a piston 1000, including a piston wedge 1100, affixed to piping (not depicted) of a downhole rodless pump actuator (see FIG. 3, 4A, 5A, for example) is displayed in FIG. 10A. The piston wedge 1100 may be shown slid into a top portion of the piston 1000. To secure the piston wedge 1100 to the piston 1000, at least one extraction bolt 1110 may be positioned through an outer protrusion of the piston wedge 1100 and into the body of the piston 1000. The piston wedge 1100 may provide a friction seal to the actuator rod 1120 in order to prevent movement of the piston 1000 along the actuator rod 1120. In embodiments, as shown in FIG. 9B, three extraction bolts 910 may be utilized to connect a piston wedge 950 to a piston 1000. In embodiments, as shown in FIG. 10B, three extraction bolts 1110 may be utilized to connect a piston wedge 1100 to a piston 1000. The three remaining holes 1130 may be used to insert bolts 1110 in order to disconnect the piston wedge 1100 from the piston 1000.

Figure 11A:
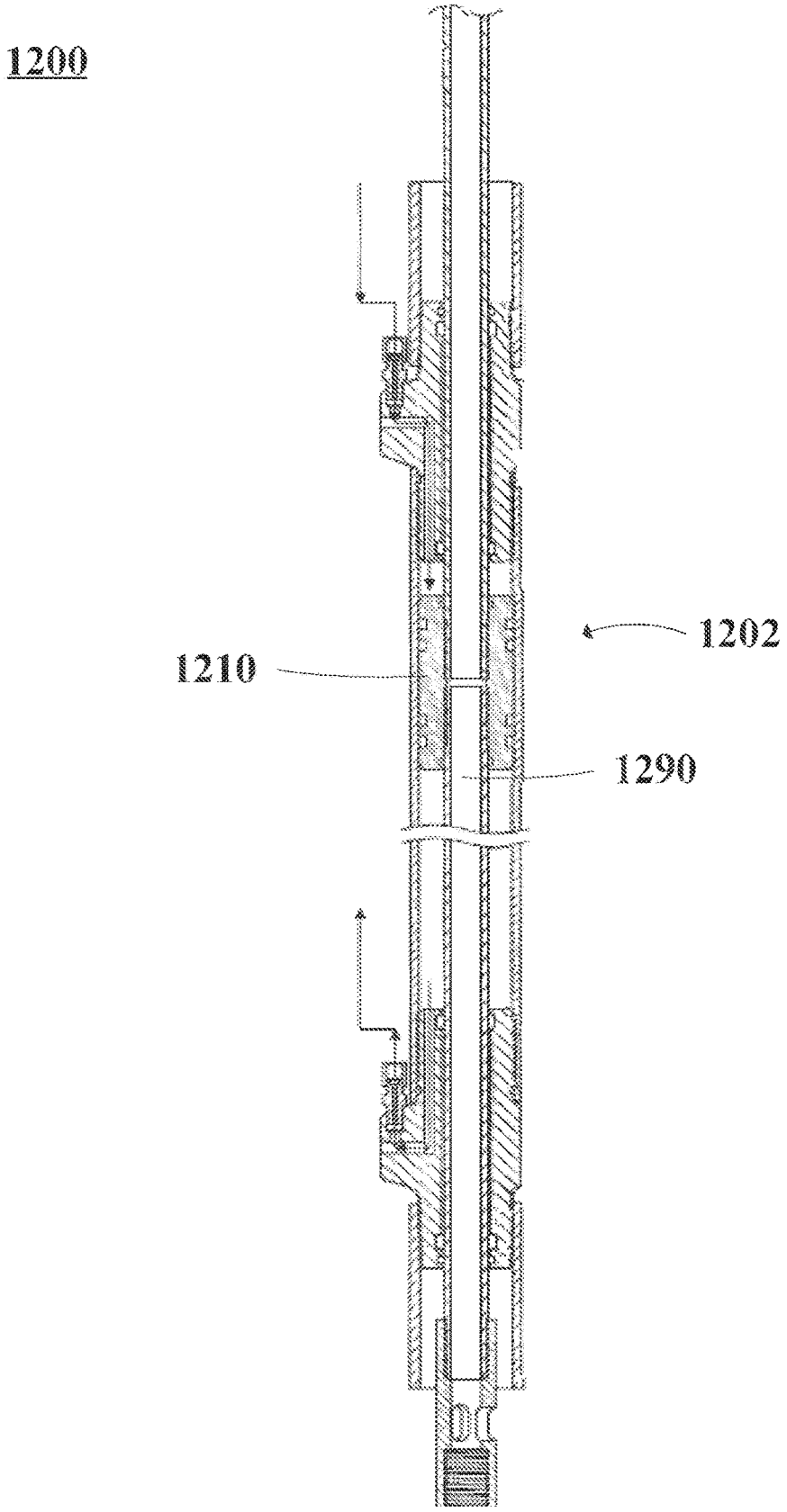
FIG. 11A depicts a partial cross-section row diagram view of a hydraulic downhole rodless pump actuator in a system for artificial lift including apparatus having a downhole rodless pump actuator in accordance with embodiments.

FIG. 11A depicts a partial cross-section flow diagram view of a hydraulic downhole rodless pump actuator 1202 in a system 1200 for artificial lift in accordance with embodiments. The piston 1210 of the pump actuator 1202 is depicted near the top-end position and may be ready to be actuated downward via at least one fluid or pressurized gas.

Figure 11B:
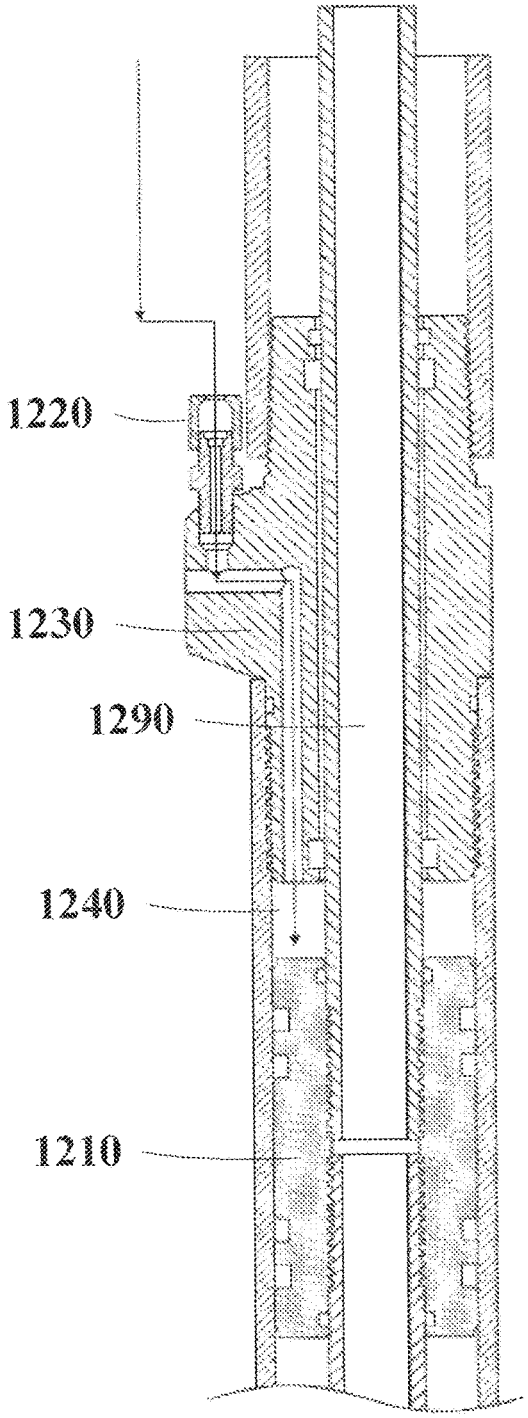
FIG. 11B depicts an enlarged top partial cross-section flow diagram view of a hydraulic downhole rodless pump actuator of FIG. 11A in a system for artificial lift including apparatus having a downhole rodless pump actuator in accordance with embodiments.
Figure 11C:
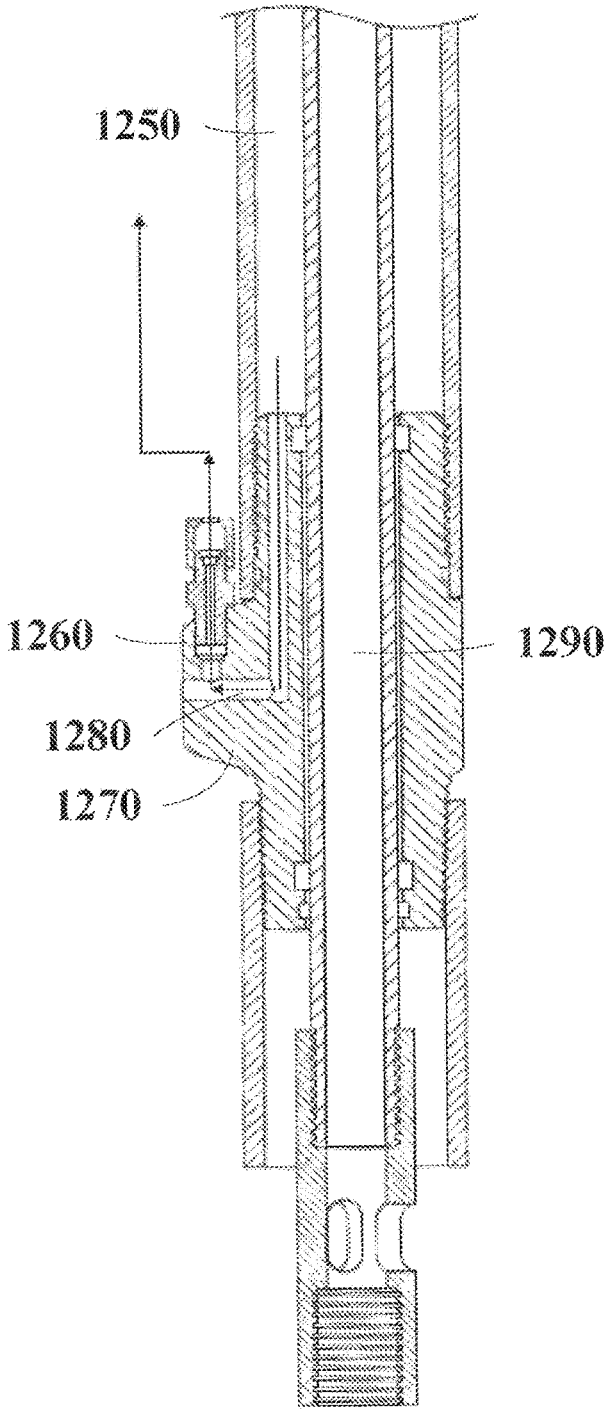
FIG. 11C depicts an enlarged bottom partial cross-section flow diagram view of a hydraulic downhole rodless pump actuator of FIG. 11A in a system for artificial lift including apparatus having a downhole rodless pump actuator in accordance with embodiments.

FIG. 11B depicts an enlarged upper partial cross-section schematic flow diagram view of the hydraulic downhole rodless pump actuator 1202 of FIG. 11A. Hydraulic fluid or a pressurized gas may first enter the upper inlet portion 1220 of the pump actuator 1202 found on the left hand side of the pump actuator 1202 (the flow shown with arrows). The fluid may flow through a hollow portion of the upper end cap 1230 of the pump actuator 1202 (see FIG. 11A) and may flow into an upper chamber 1240 above the piston 1210. The pressure of the fluid or gas may push the piston 1210 in a downward direction, forcing fluid or gas in a lower chamber 1250 (below the piston 1210) out of the pump actuator 1202 and through a lower inlet portion 1260 via a hollow portion 1280 in the lower end cap 1270, as shown in FIG. 11C. The piston 1210 may be pushed downward into a bottom-end or "starting position." As the piston 1210 is pushed downward, the actuator rod 1290 may be pushed downward within the well (not depicted) due to the fact that the piston 1210 is directly affixed to the actuator rod 1290. In embodiments, the fluid entering and leaving the pump actuator 1202 may be the same type of fluid or pressurized gas. In embodiments, the fluid entering and leaving the pump actuator 1202 may each be different types of fluids.

Figure 12A:
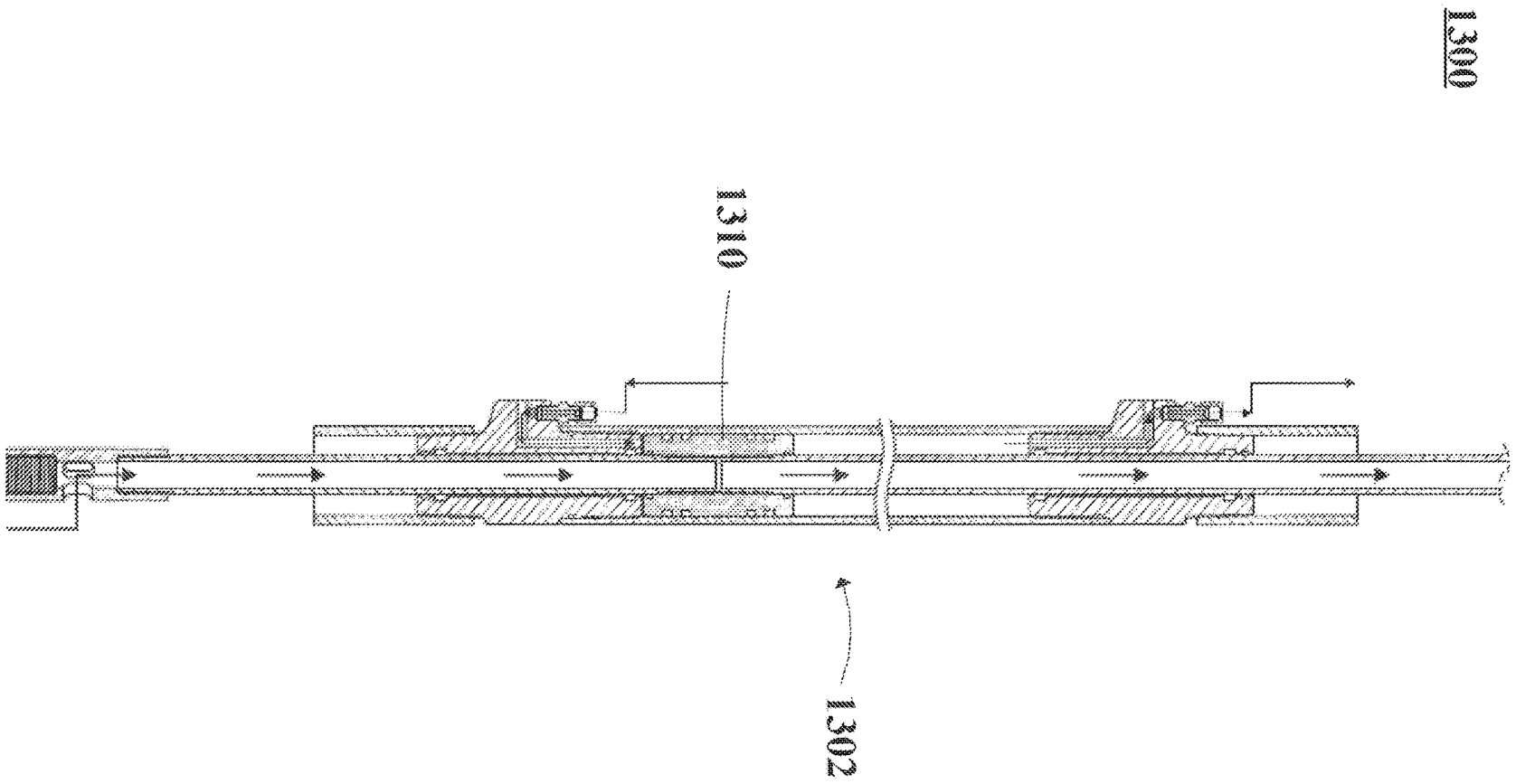
FIG. 12A depicts a partial cross-section flow diagram view of a hydraulic downhole rodless pump actuator in a system for artificial lift including apparatus having a downhole rodless pump actuator in accordance with embodiments.

FIG. 12A depicts a partial cross-section flow diagram view of a hydraulic downhole rodless pump actuator 1302 In a system 1300 for artificial lift in accordance with embodiments. The piston 1310 of the pump actuator 1302 is depicted in the "down" position and may be ready to be actuated upward via at least one fluid or pressurized gas.

Figure 12B:
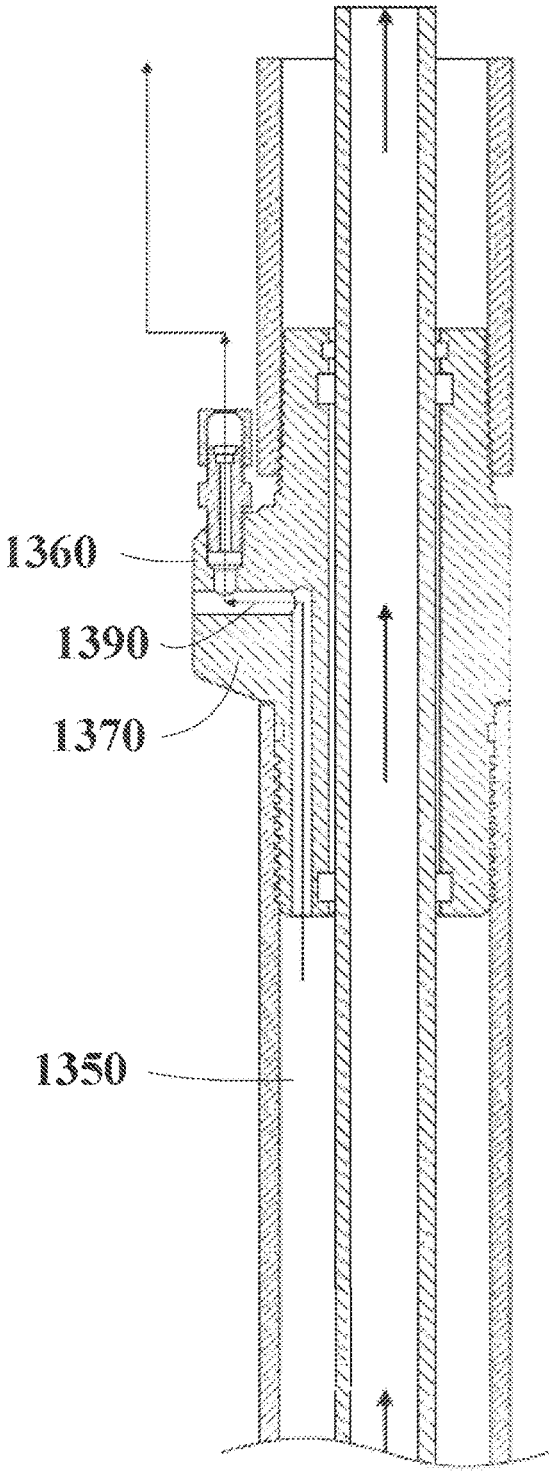
FIG. 12B depicts an enlarged top partial cross-section flow diagram view of a hydraulic downhole rodless pump actuator of FIG. 12A in a system for artificial lift including apparatus having a downhole rodless pump actuator in accordance with embodiments.
Figure 12C:
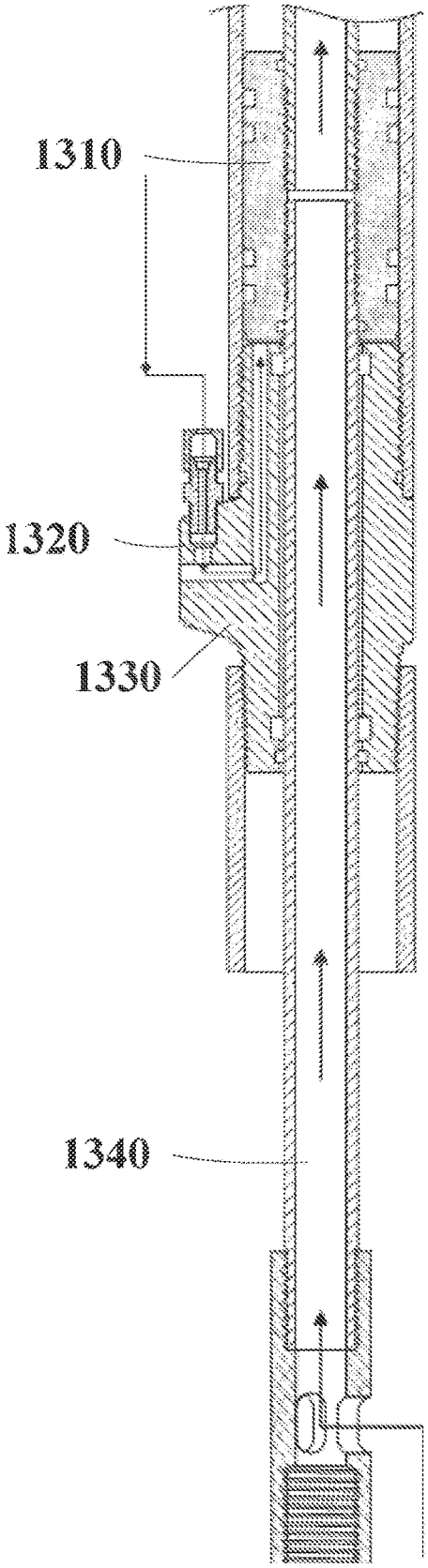
FIG. 12C depicts an enlarged bottom partial cross-section flow diagram view of a hydraulic downhole rodless pump actuator of FIG. 12A in a system for artificial lift including apparatus having a downhole rodless pump actuator in accordance with embodiments.

FIG. 12B depicts an enlarged upper partial cross-section schematic flow diagram view of the hydraulic downhole rodless pump actuator 1302 of FIG. 12A. Hydraulic fluid or pressurized gas may first enter the lower inlet portion 1320 of the pump actuator 1302 found on the left hand side of the pump actuator 1302 (the flow shown with arrows), as shown in FIG. 12C. The fluid or gas may flow through a hollow portion of the lower end cap 1330 of the pump actuator 1302 and may flow into a lower chamber (not depicted) below the piston 1310. The pressure of the fluid or gas may push the piston 1310 in an upward direction, forcing fluid or gas in an upper chamber 1350 (above the piston 1310) out of the actuator and through an upper inlet portion 1360 via a hollow portion 1390 in an upper end cap 1370. The piston 1310 may be pushed upward until the piston 1310 reaches a top-end position and cannot travel further. As the piston 1310 is pushed upward, the actuator rod 1340 may be pulled upward within the well (not depicted) due to the fact that the piston 1310 is directly affixed to the actuator rod 1340. Suction formed by this upward movement in the area of the well surrounding the exposed actuator rod 1340 may pull production fluid (not depicted) out of the well and through actuator rod 1340 orifices. The hydrocarbons may then flow upward through the actuator rod 1340 and up through the production tubing to the surface (not depicted). In embodiments, the fluid or gas entering and leaving the pump actuator 1302 may be the same type of fluid. In embodiments, the fluid entering and leaving the pump actuator 1302 may each be different types of fluids.

Figure 13A:
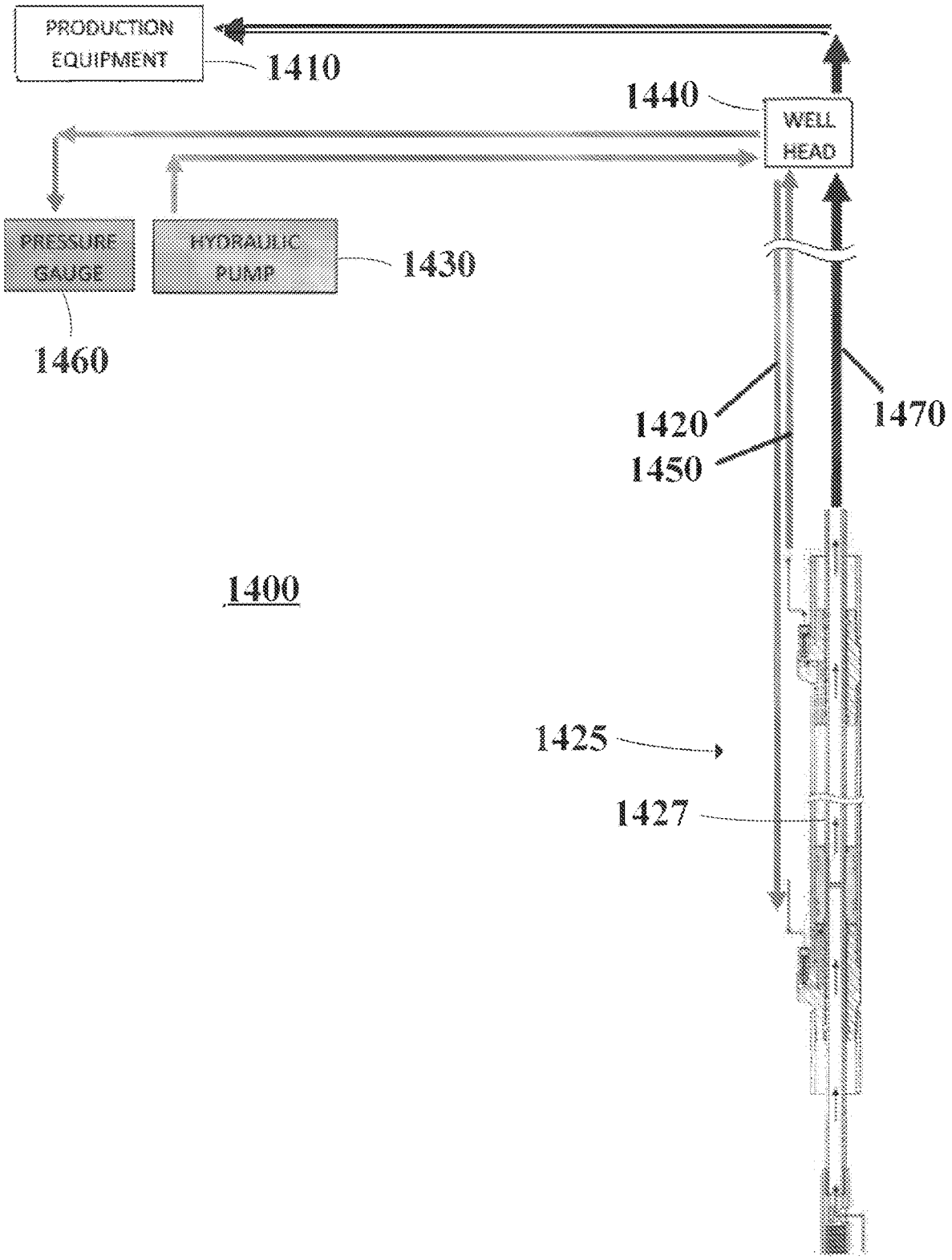
FIG. 13A depicts a schematic diagram of a system for artificial lift including apparatus having a downhole rodless pump actuator in accordance with embodiments and indicating flow of hydraulic fluids from the surface of a well to the actuator as moved in an up-stroke.

FIG. 13A depicts a schematic diagram of a system 1400 for artificial lift including a downhole rodless pump actuator 1425 in accordance with embodiments and indicating flow of hydraulic fluids from the surface (not depicted) of a well (not depicted) to the pump actuator 1425 as moved in an up-stroke. In embodiments, the actuator may be attached to a well's production tubing/equipment 1410 with a standard sucker rod pump (not depicted) attached to the actuator rod 1427. From the surface of the well, hydraulic fluids may be pumped into capillary line 1420 down to the pump actuator 1425 via the hydraulic pump 1430 and well head 1440. Simultaneously, pressurized gas may be forced out of the pump actuator 1425 and into capillary line 1450 to be monitored at the pressure gauge 1460 on the surface. As this occurs, production fluid (depicted as line 1470) may be pulled from the well through the actuator rod 1427, into production tubing 1410, and moved upwardly therethrough to the surface of the well. It is noted that the downhole rodless pump actuator 1425 may be, but is not limited to, in embodiments, the downhole rodless pump actuator of FIGS. 1A, 2, 3, 4A, SA, 6A, 7A, 8, 11A, and 12A.

Figure 13B:
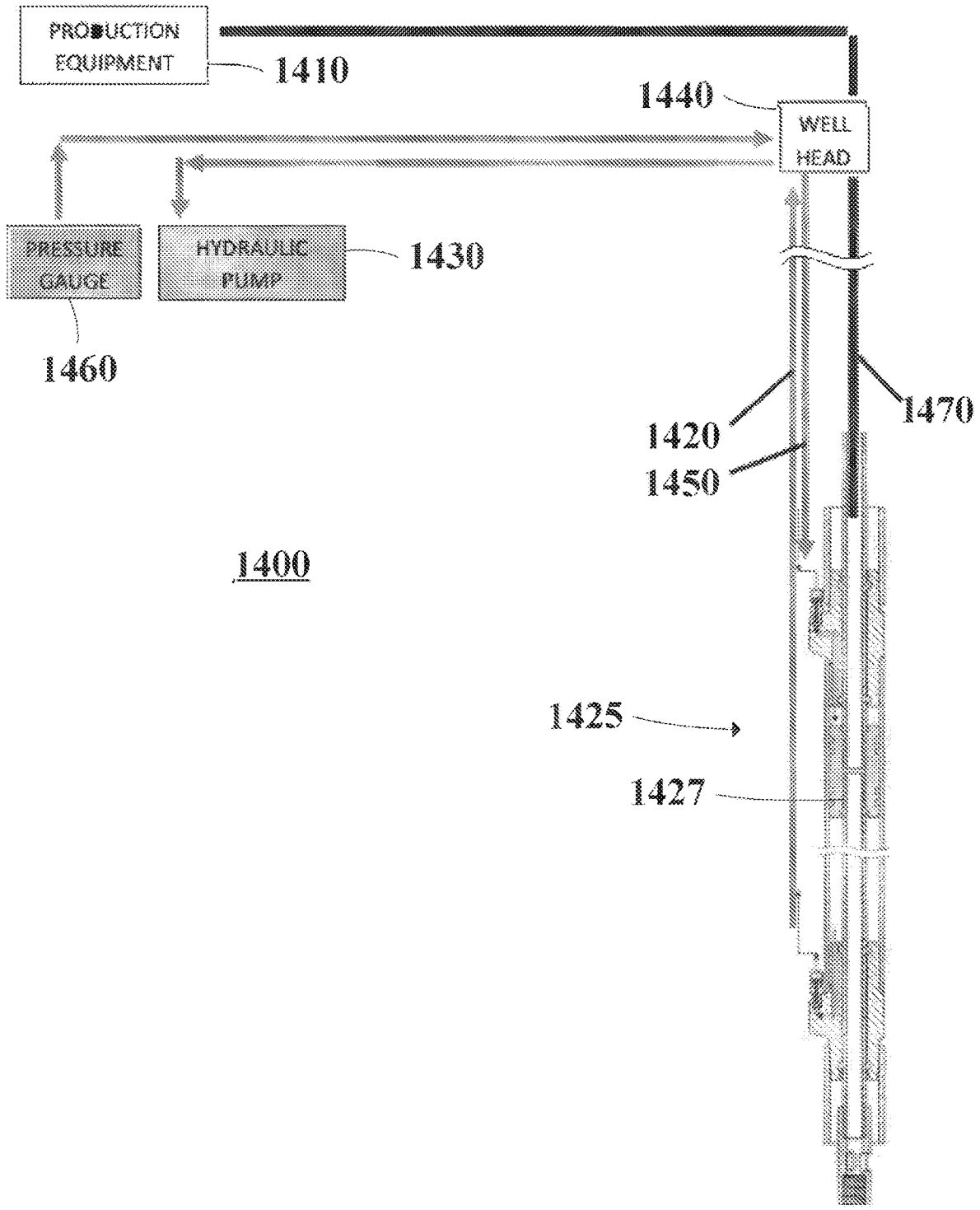
FIG. 13B depicts a schematic diagram of a system for artificial lift including apparatus having a downhole rodless pump actuation in accordance with embodiments and indicating flow of hydraulic fluids from the surface of a well to the actuator as moved in a down-stroke.

FIG. 13B depicts a schematic diagram of a system 1400 for artificial lift having a downhole rodless pump actuator 1425 in accordance with embodiments and indicating flow of hydraulic fluids from the surface of a well (not depicted) to the pump actuator 1425 as moved in a down-stroke. In embodiments, the pump actuator 1425 may typically be attached to a well's production tubing/equipment 1410 with a standard sucker rod pump (not depicted) attached to the actuator rod 1427. From the pump actuator 1425, pressurized gas in capillary line 1450 may force the hydraulic fluid out of the pump actuator 1425 and into capillary line 1420. Simultaneously, hydraulic fluid may be allowed to flow back to the hydraulic pump 1430 at the surface (not depicted). During this time, production fluid (depicted as line 1470) may remain stagnant until the beginning of the next upstroke. It is noted that the pump actuator 1425 may be, but is not limited to, in embodiments, the downhole rodless pump actuator of FIGS. 1A, 2, 3, 4A, SA, 6A, 7A, 8, 11A, and 12A.

In embodiments, at least one of the surface equipment and hydraulic pressure equipment may operate via at least one of a timer, pressure sensor, flow meter, or any number of measurement choices, to alternate between on and off cycles for the hydraulic pump 1430 at the surface to either pump hydraulic fluid to pump actuator 1425 (*on*) or to allow hydraulic fluid to return to the surface (off).

Figure 14A:
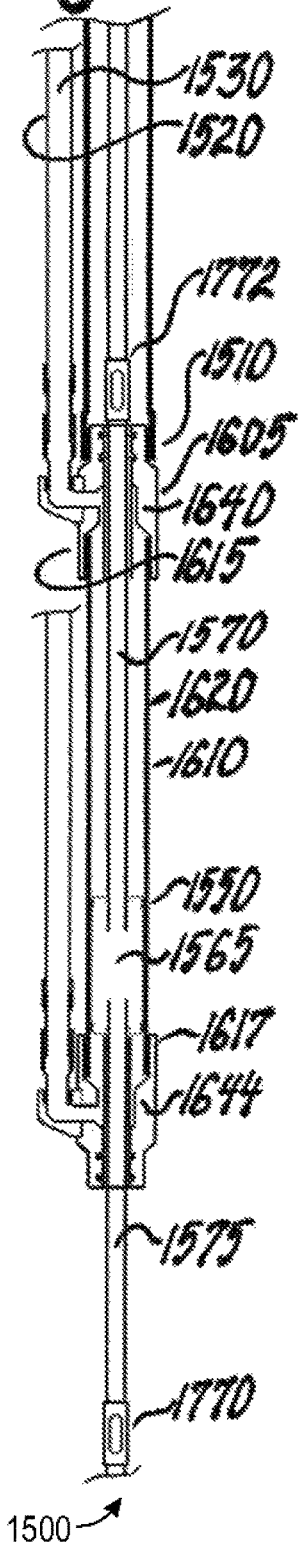
FIG. 14A is a simplified schematic partial side cross-section view of a hydraulic downhole rodless pump actuator in a system for artificial lift in accordance with an exemplary embodiment, with the piston at bottom-end of a stroke.

FIG. 14A is a simplified schematic partial side cross-section view of a downhole rodless hydraulic pump actuator 1510 ("pump actuator 1510") in a system 1500 for artificial lift ("artificial lift system 1500") in a hydrocarbon production well 1503 (for example, as shown in FIGS. 13A-13B) in accordance with an exemplary embodiment. Except as otherwise illustrated in FIG. 14A-41, or otherwise described herein in relation to the illustrations, artificial lift system 1500 may be identical to embodiments of hydraulic artificial lift systems 1200 and 1300 previously described hereinabove and shown in FIGS. 11A-11C and 12A-12C.

Figure 44:
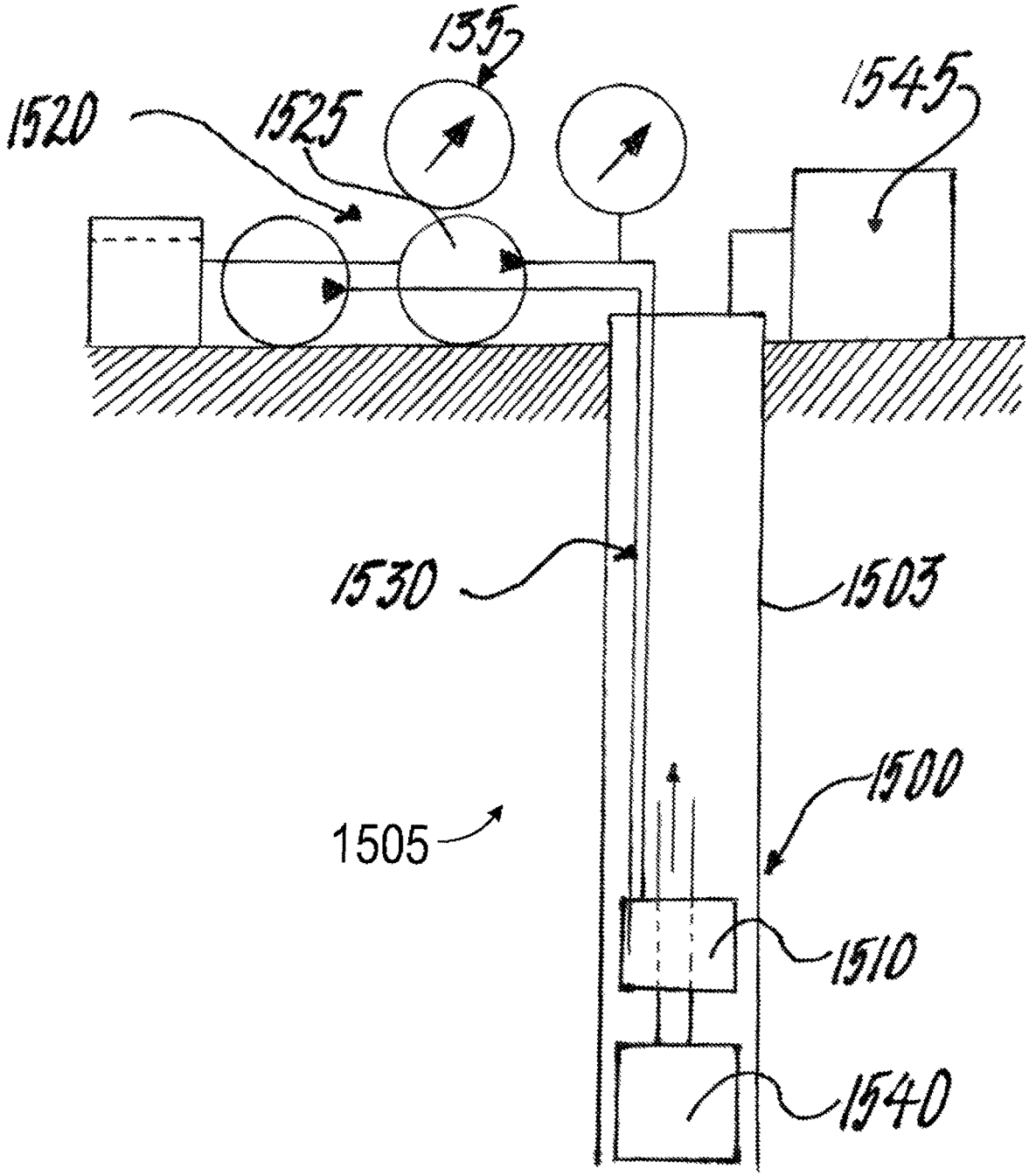
FIG. 44 is a simplified schematic diagram illustrating a hydrocarbon production well including an artificial lift system having a downhole rodless hydraulic pump actuator in accordance with an exemplary embodiment shown generally in FIGS. 14A-14C and 15.

Referring to FIG. 44, system 1500 may include a hydraulic system 1520 connected to pump actuator 1510 to cause and actuate cyclical stroking of the pump actuator 1510. Hydraulic system 1520 may include a hydraulic pump 1525, a set of downhole hydraulic tubes 1530 and hydraulic control system 135. The set of hydraulic tubes may extend from hydraulic pump 1525 downhole to pump actuator 1510 to provide pressurized hydraulic fluid to pump actuator 1510. As described above for other embodiments, the hydraulic pump 1525 may be located at the surface or at any location relative to the well 1503, which is suitable for the hydraulic pump 1525 to pressurize hydraulic fluid to be supplied through the hydraulic tubes 1530 to the pump actuator 1510 located downhole in the production well 1503. The pump actuator 1510 may be connected in driving relationship with a plunger pump 1540. In some embodiments, for example, the plunger pump 1540 may be a pre-existing sucker rod actuated plunger pump which has been removed from a rod-pumped configuration in the same or a different well and reused with the downhole rodless hydraulic pump actuator 1510. In other embodiments, the plunger pump may be designed and configured for use with a hydraulic pump actuator as herein disclosed, or may be configured in integral relationship with a hydraulic pump actuator as disclosed. It will be understood that as used herein "rod-less" means that a combination of sucker rod string and pump jack may be omitted from the well system, and that instead a plunger pump otherwise designed for use in a sucker rod-pumped configuration instead may be articulated by operation of a downhole rodless hydraulic pump actuator. The plunger pump from a rod-pumped configuration may be reused in combination with the pump actuator 1510. In the particular embodiment shown in FIG. 14A, for example, the plunger pump 1540 may be a Harbison-Fischer® rod pump (available from Dover® Artificial Lift, The Woodlands, Tex.) such as, for example, a Harbison-Fischer® Pampa® model rod pump.

Figure 14B:
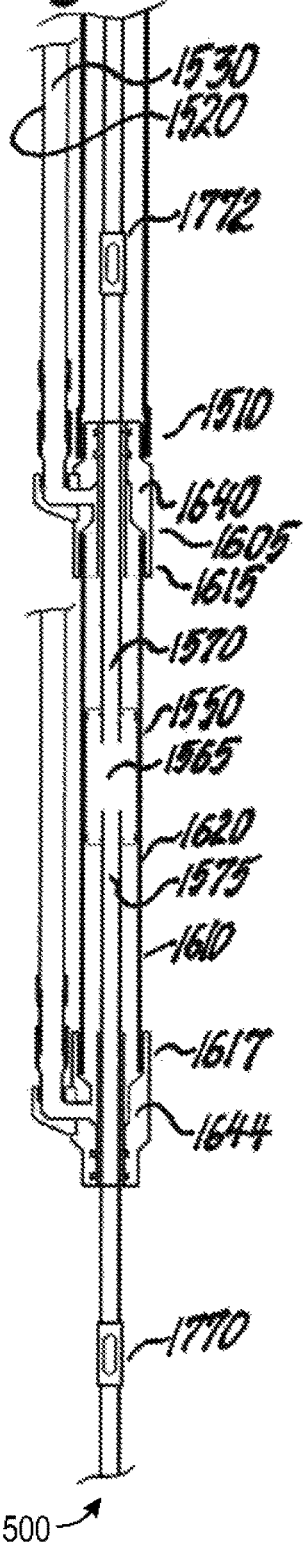
FIG. 14B is a view of the pump actuator similar to FIG. 14A, with the actuator piston at mid-stroke.
Figure 14C:
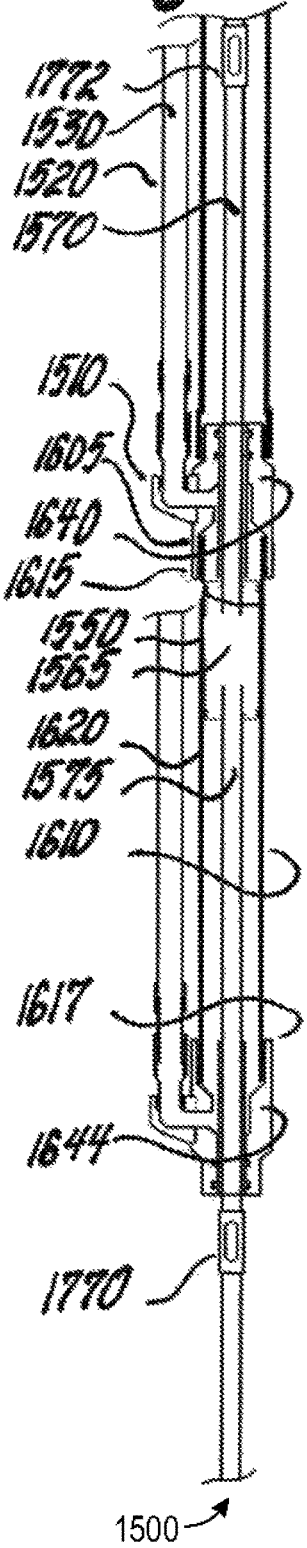
FIG. 14C is a view of the pump actuator similar to FIGS. 14A-14B, with the actuator piston at top-end of a stroke.
Figure 15:
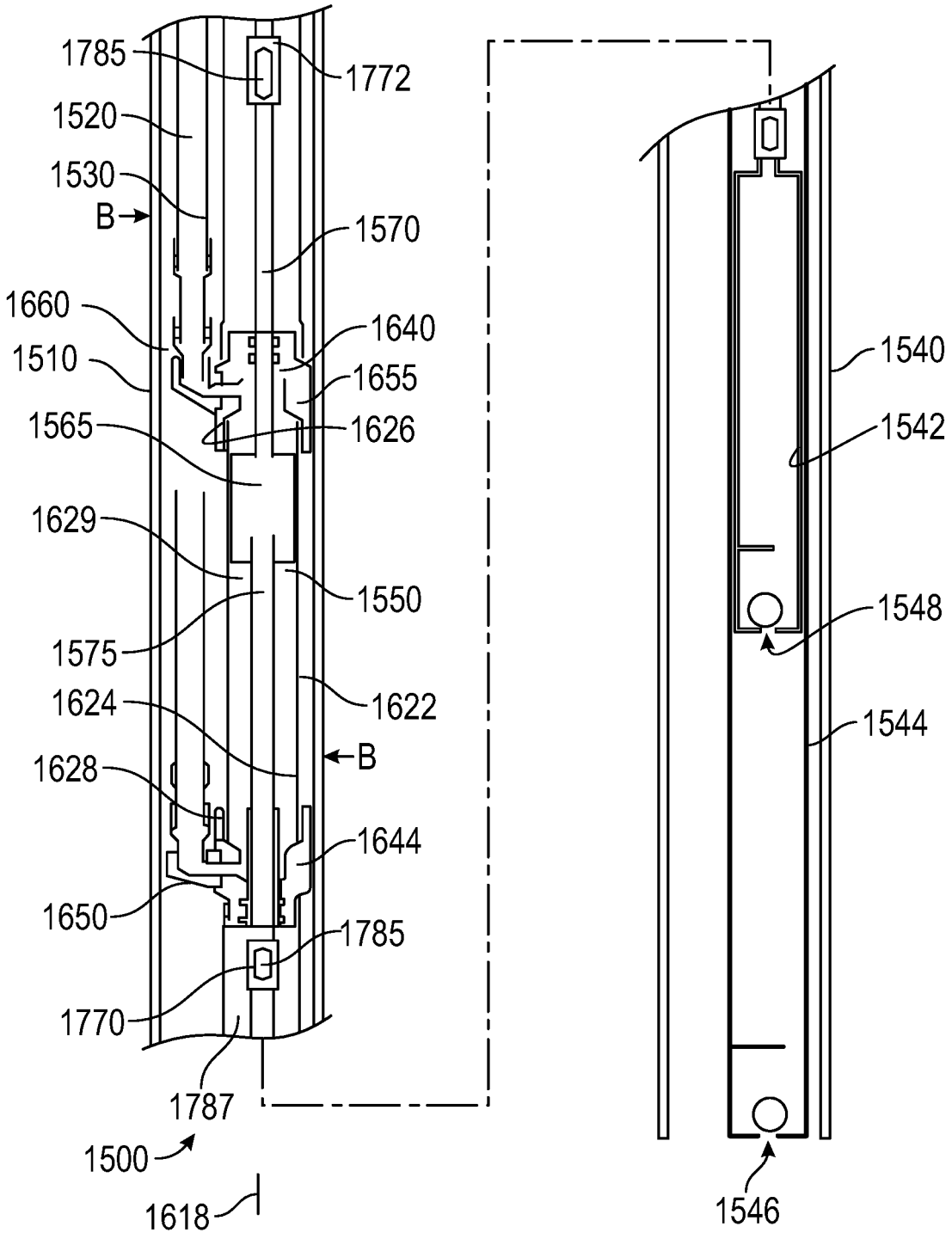
FIG. 15 is an enlarged simplified, schematic partial cross-section view of the pump actuator shown generally in FIGS. 14A-14C with the actuator piston at top-end of a stroke, in combination with a plunger pump.
Figure 16:
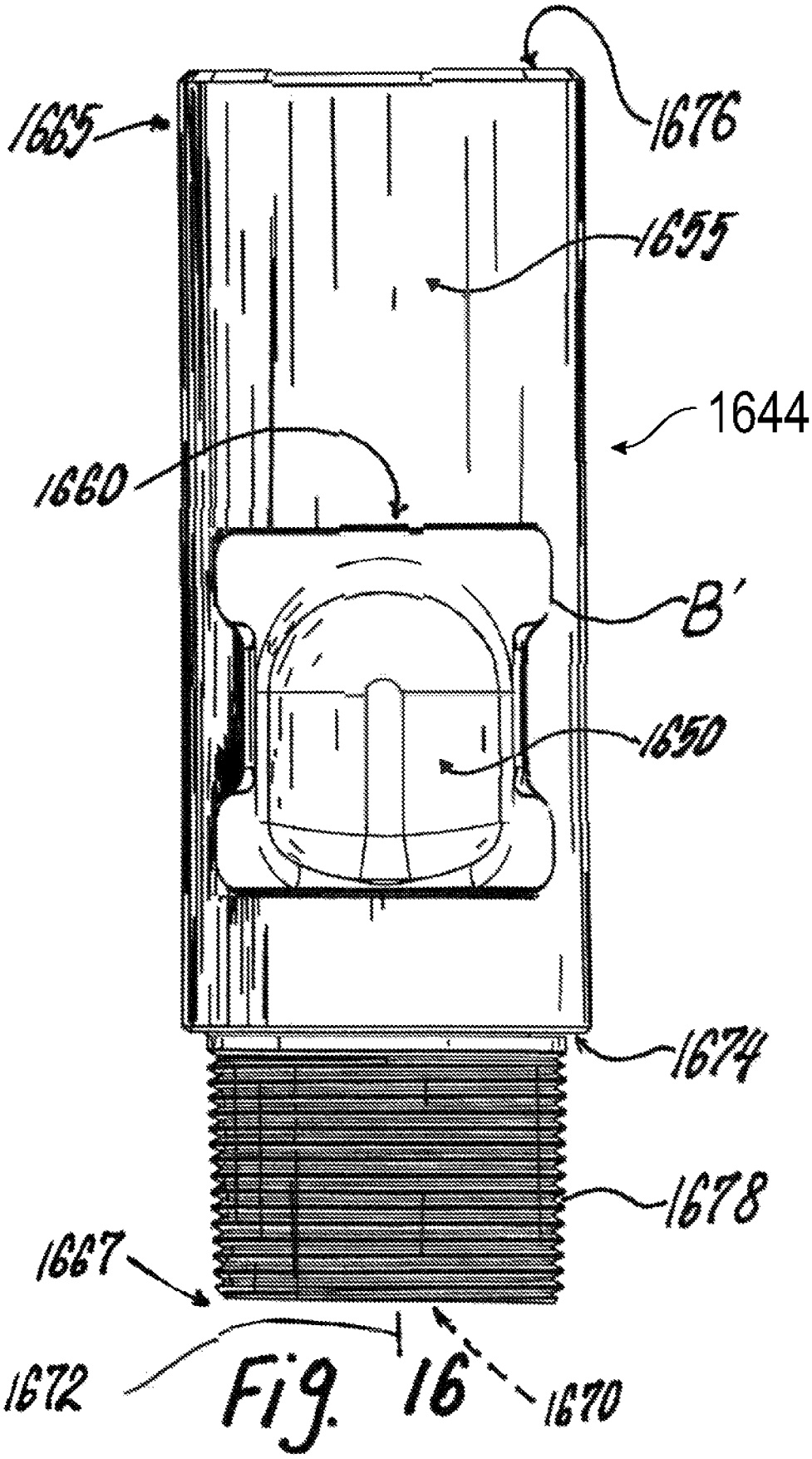
FIG. 16 is an enlarged simplified top perspective view of an end cap assembly for the pump actuator shown generally in FIGS. 14A-14C.
Figure 17:
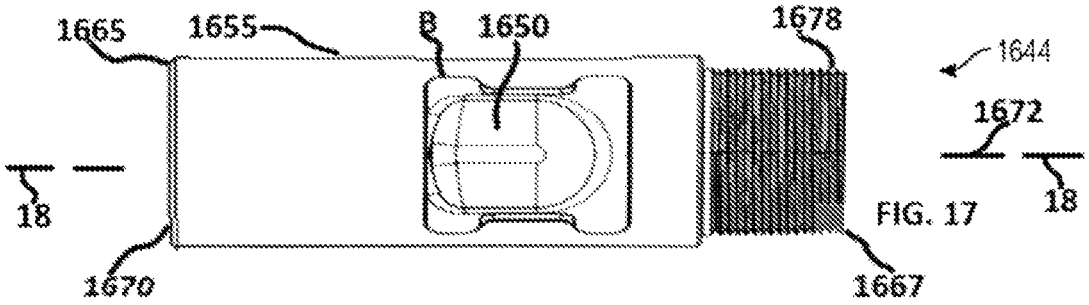
FIG. 17 is a simplified top view of the end cap assembly shown generally in FIG. 16.
Figure 18:
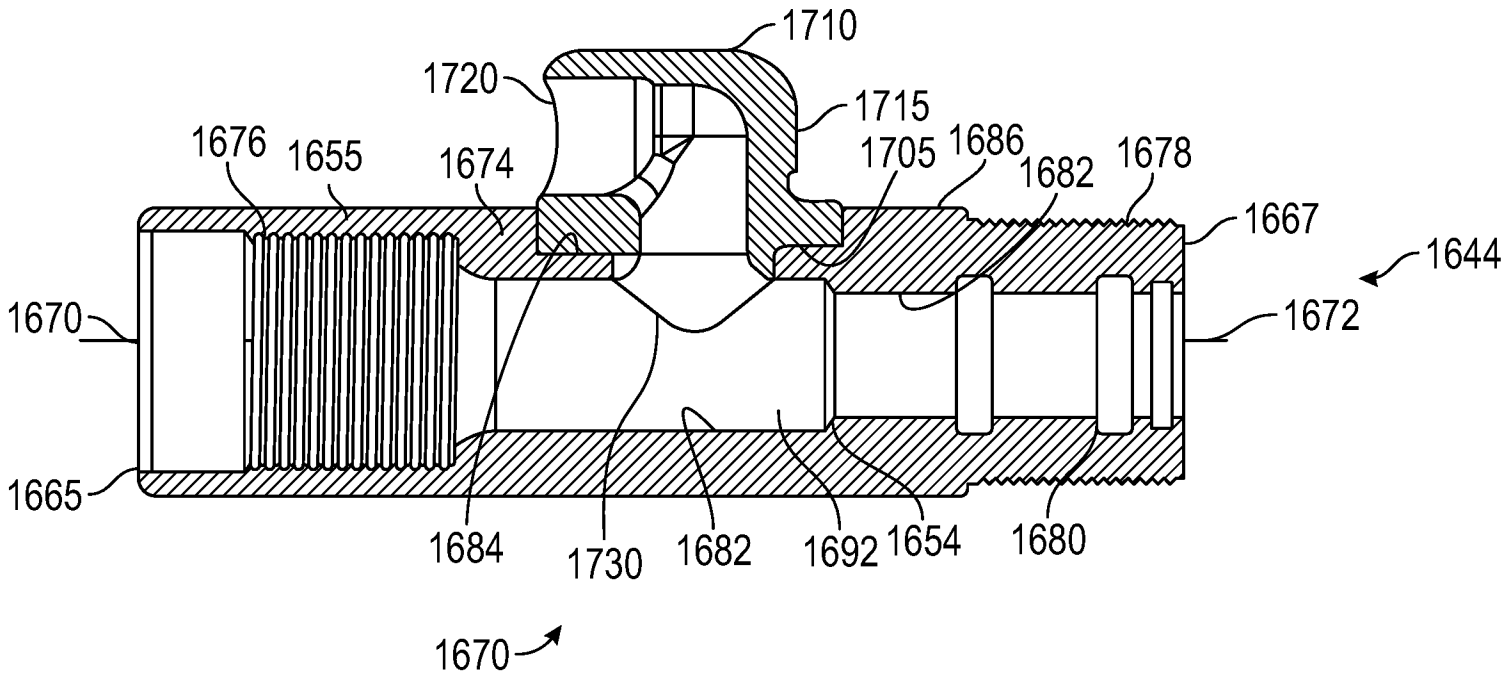
FIG. 18 is a simplified side cross-section view of the end cap assembly, taken generally along 18-18 in FIG. 17.
Figure 19:
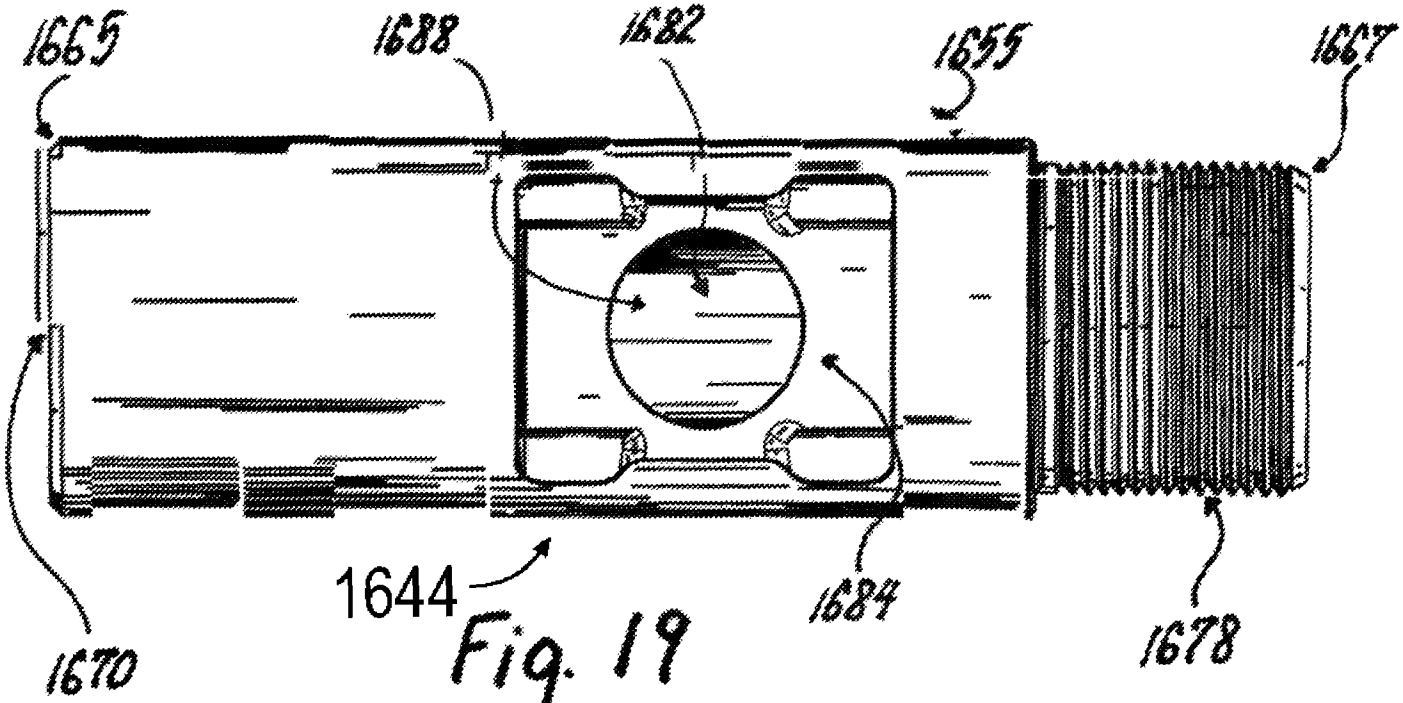
FIG. 19 is an enlarged simplified upper perspective isolation view of an end cap body for the end cap assembly shown generally in FIG. 16, with the bung omitted.
Figure 20:
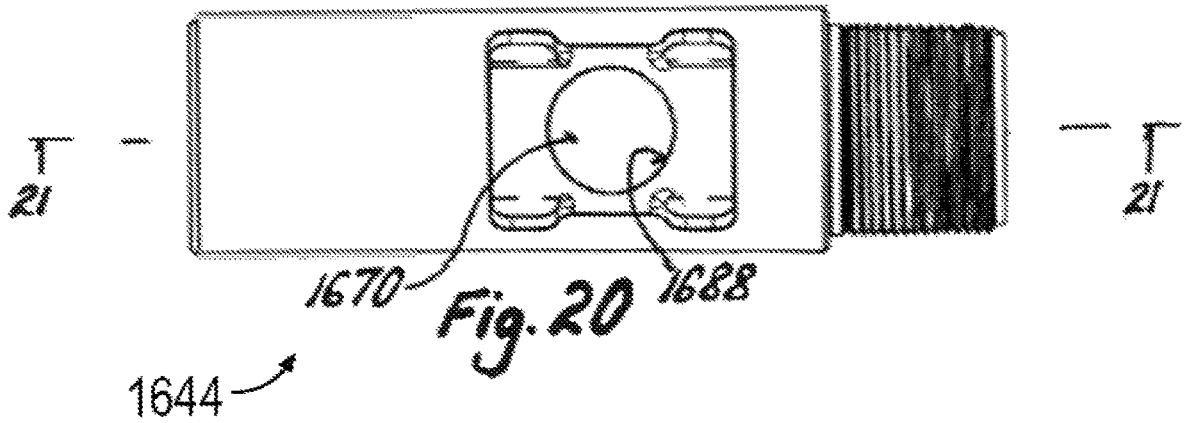
FIG. 20 is a simplified top isolation view of the end cap body shown generally in FIG. 19.
Figure 21:
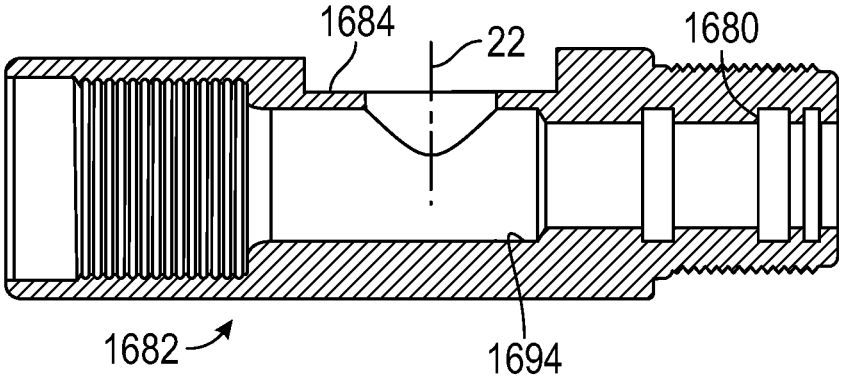
FIG. 21 is a simplified side cross-section isolation view of the end cap body, taken generally along 21-21 in FIG. 20.
Figure 22:
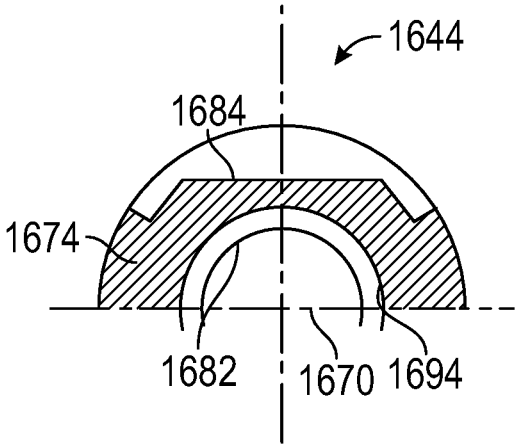
FIG. 22 is a simplified longitudinal cross-section isolation view of the end cap body, taken generally along 22-22 in FIG. 21.
Figure 23:
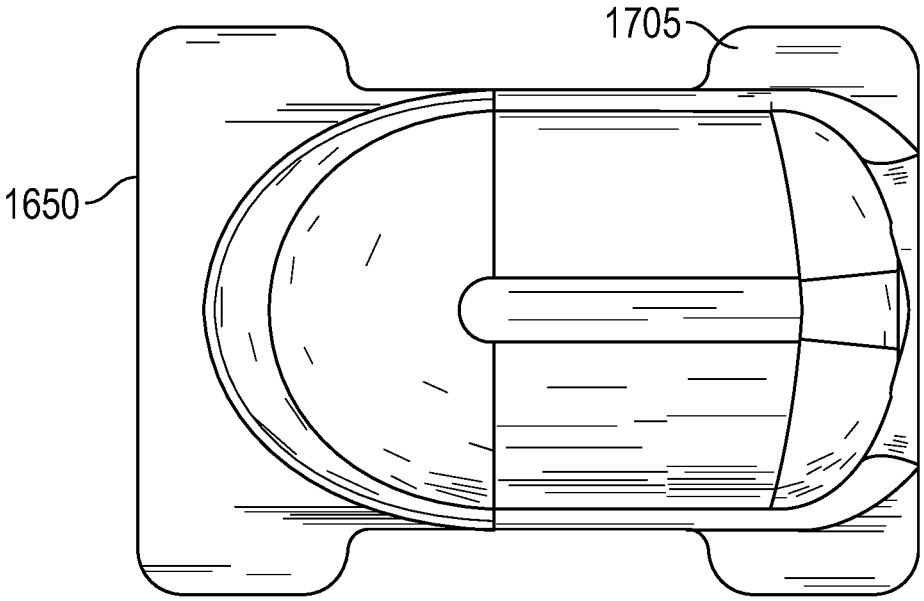
FIG. 23 is an enlarged simplified upper perspective isolation view of an end cap bung for the end cap assembly shown generally in FIG. 16, with the end cap body omitted.
Figure 24:
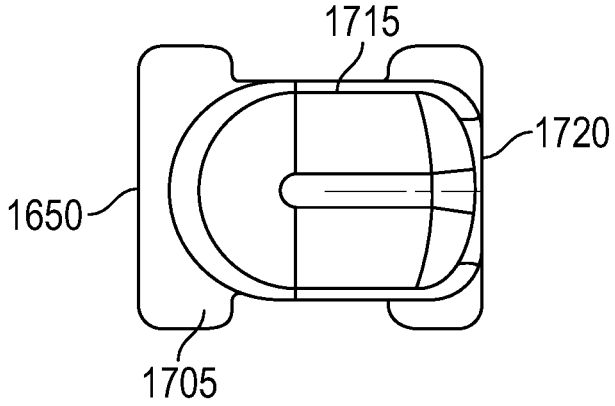
FIG. 24 is a simplified top isolation view of the end cap bung shown generally in FIG. 23.
Figure 25:
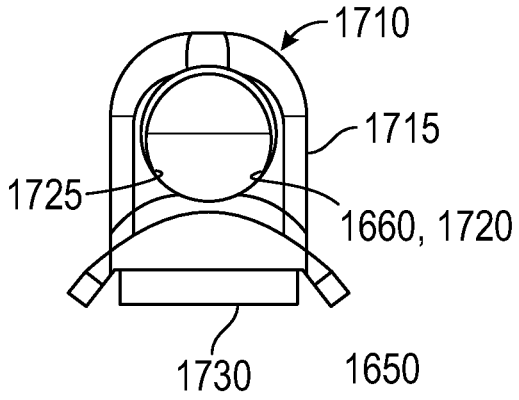
FIG. 25 is a simplified end isolation view of the end cap bung, taken generally along 25-25 in FIG. 24.
Figure 26:
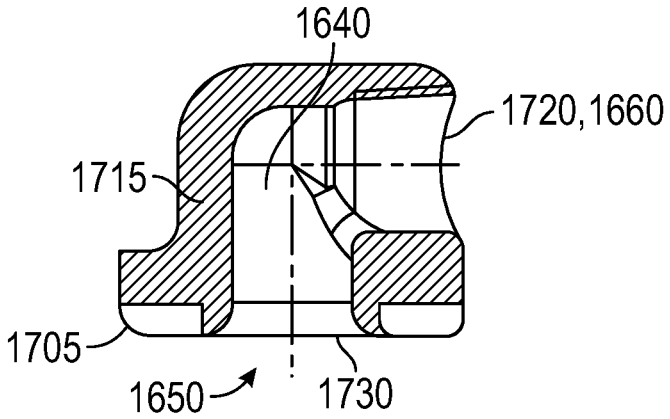
FIG. 26 is a simplified longitudinal cross-section isolation view of the end cap bung, taken generally along 26-26 in FIG. 25.
Figure 27:
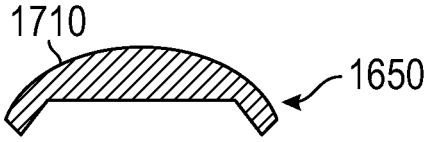
FIG. 27 is a simplified longitudinal partial cross-section isolation view of the end cap bung, taken generally along 27-27 in FIG. 26.
Figures 28, 29, 30:
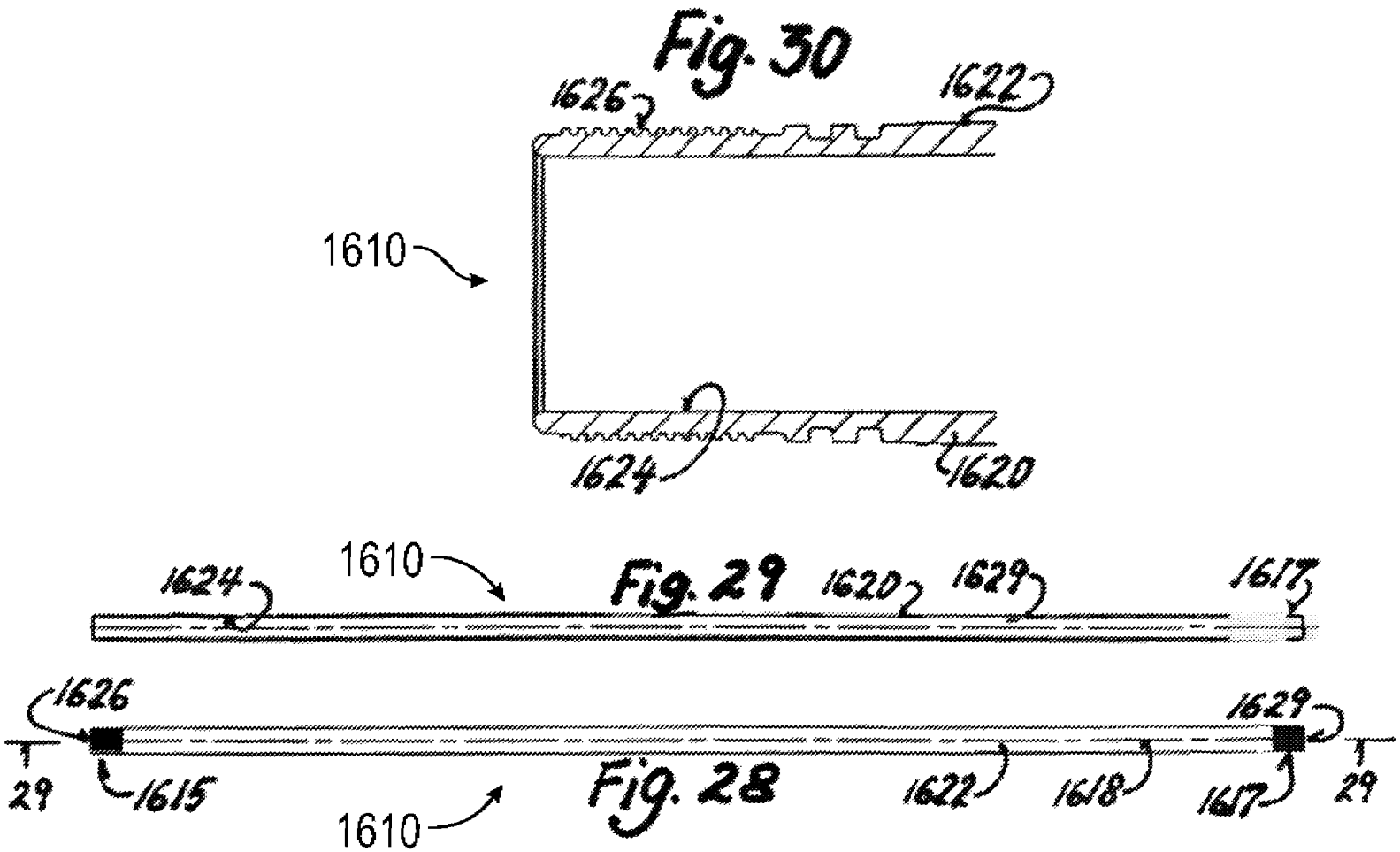
FIG. 28 is a simplified side isolation view of the actuator cylinder housing for the pump actuator shown generally in FIGS. 14A-14C.
FIG. 29 is a simplified longitudinal cross-section isolation view of the actuator cylinder housing, taken generally along 29-29 in FIG. 28.
FIG. 30 is a simplified enlarged partial longitudinal cross-section isolation view of a threaded end of the actuator cylinder housing, showing the area of detail indicated generally in FIG. 30.
Figure 31:
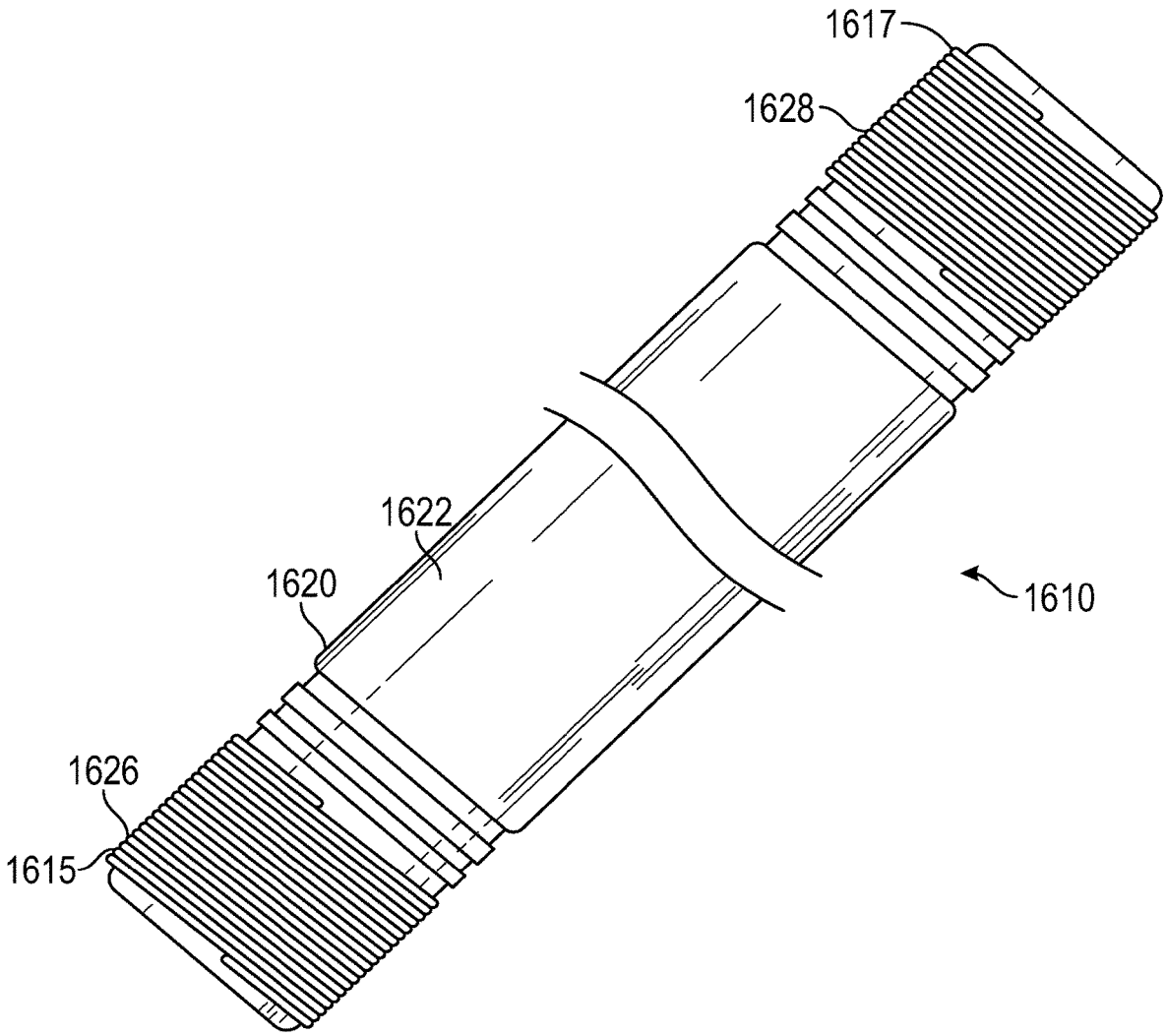
FIG. 31 is a simplified enlarged partial perspective isolation view of the threaded ends of the actuator cylinder housing, shown generally in FIG. 29.
Figure 32:
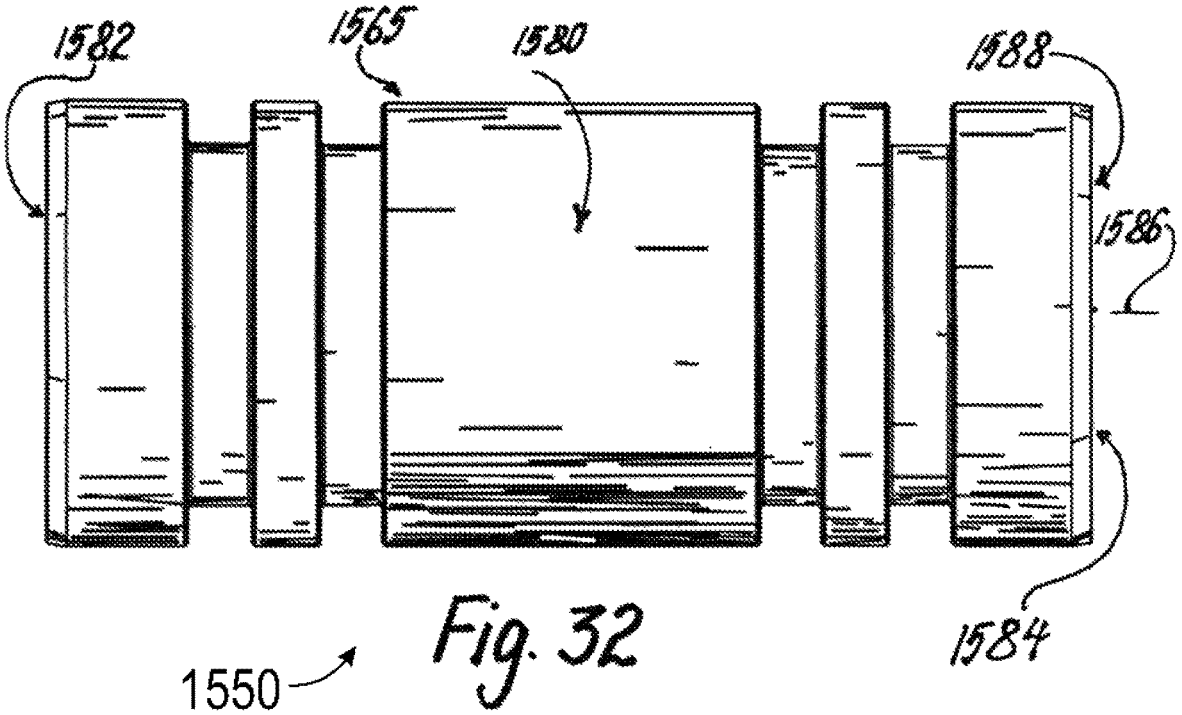
FIG. 32 is an enlarged simplified upper perspective isolation view of the actuator piston body for the pump actuator shown generally in FIGS. 14A-14C.
Figure 33:
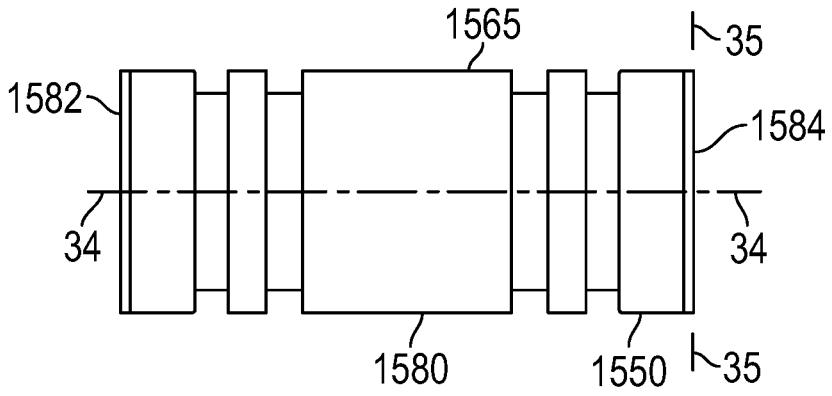
FIG. 33 is a simplified top view of the actuator piston body shown generally in FIG. 32.
Figure 34:
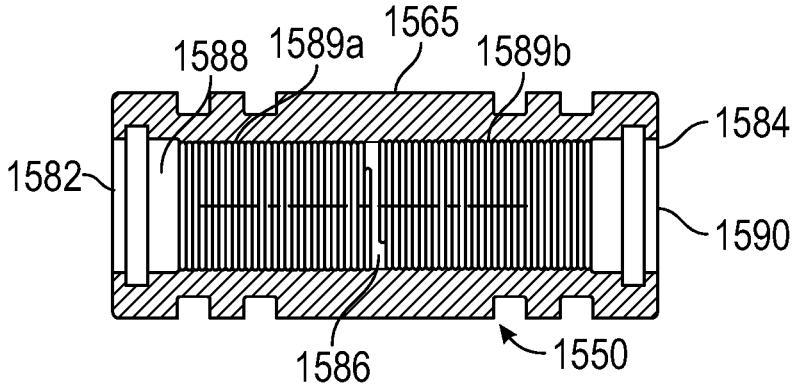
FIG. 34 is a simplified side cross-section view of the actuator piston body, taken generally along 34-34 in FIG. 33.
Figure 35:
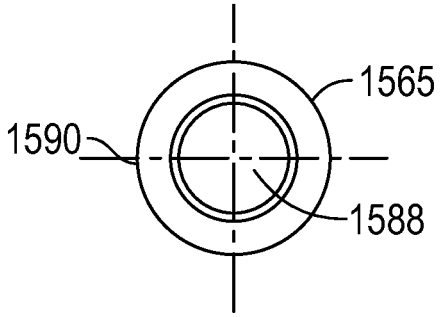
FIG. 35 is a simplified longitudinal end isolation view of the actuator piston body, taken generally along 35-35 in FIG. 33.
Figure 36:
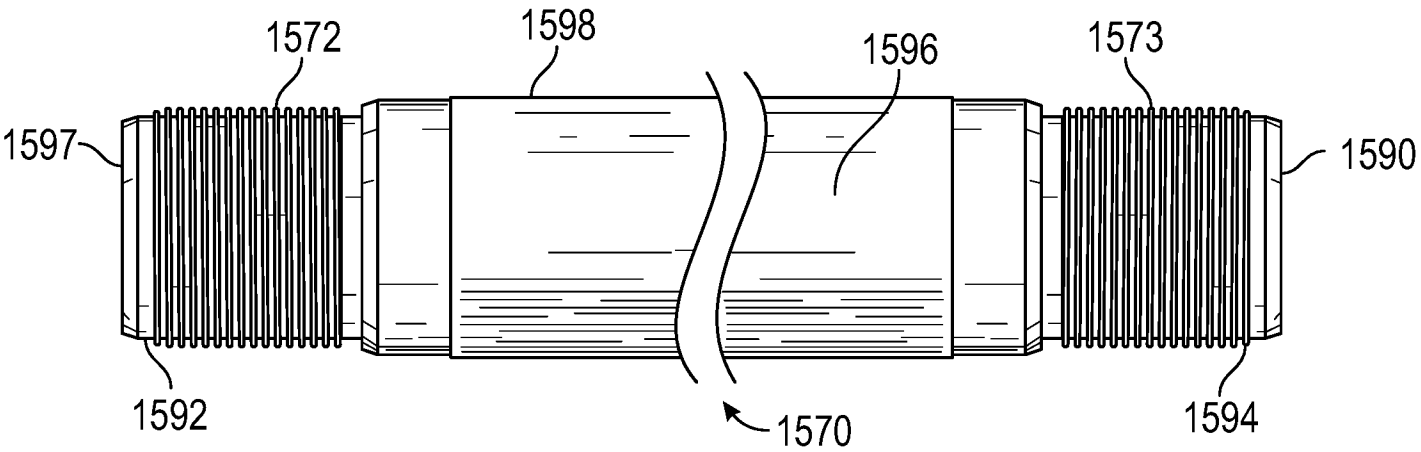
FIG. 36 is an enlarged simplified upper perspective isolation view of the actuator piston tube for the pump actuator shown generally in FIGS. 14A-14C.
Figure 38:
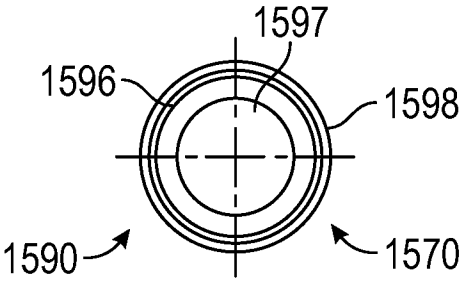
FIG. 38 is a simplified longitudinal end isolation view of the actuator piston tube, taken generally along 38-38 in FIG. 37.
Figure 37:
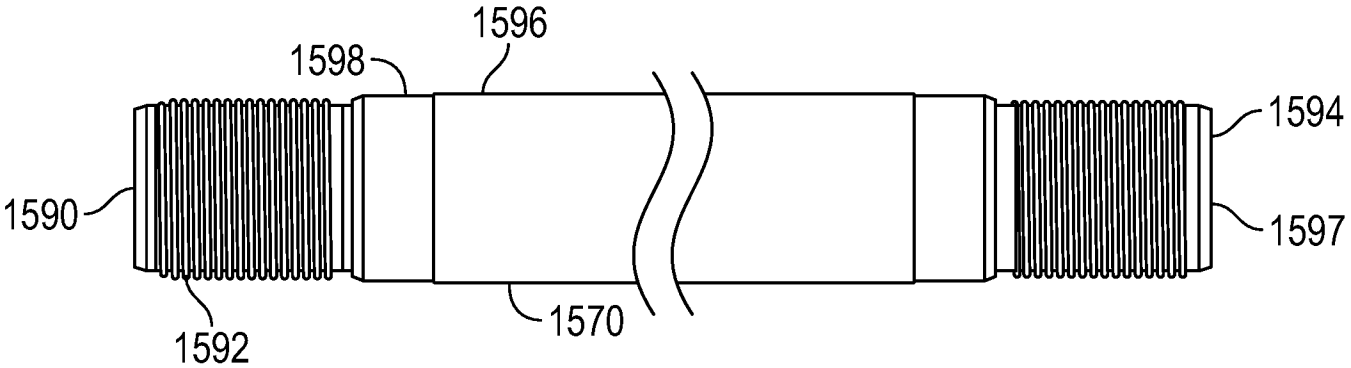
FIG. 37 is a simplified top view of the actuator piston tube shown generally in FIG. 36.
Figure 39:
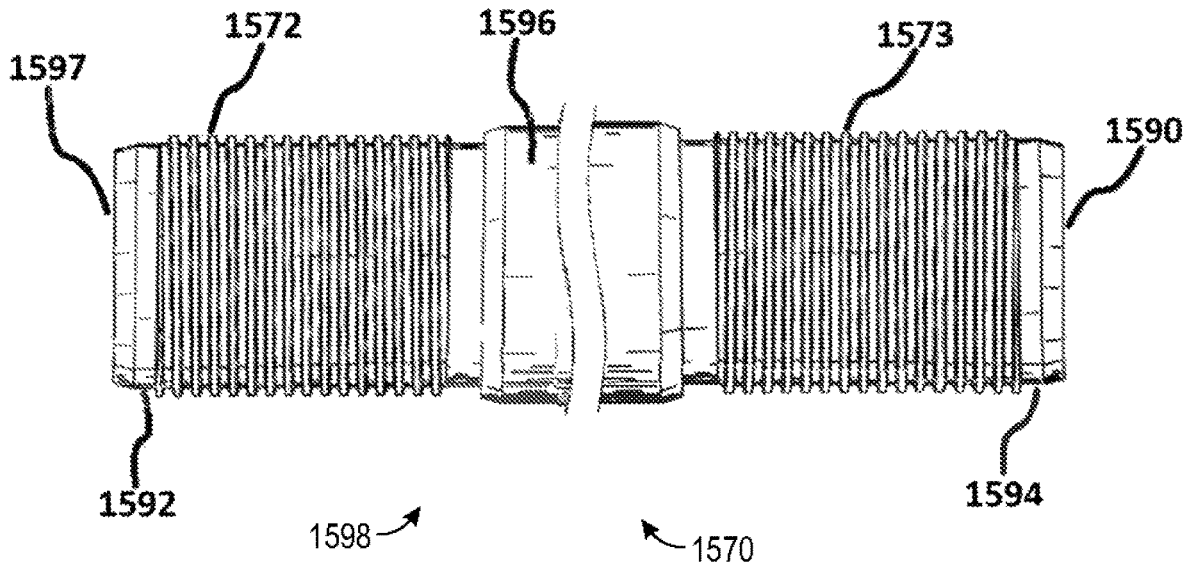
FIG. 39 is an enlarged simplified upper perspective isolation view showing detail of the threaded ends of the actuator piston tube shown in FIG. 36.
Figure 40:
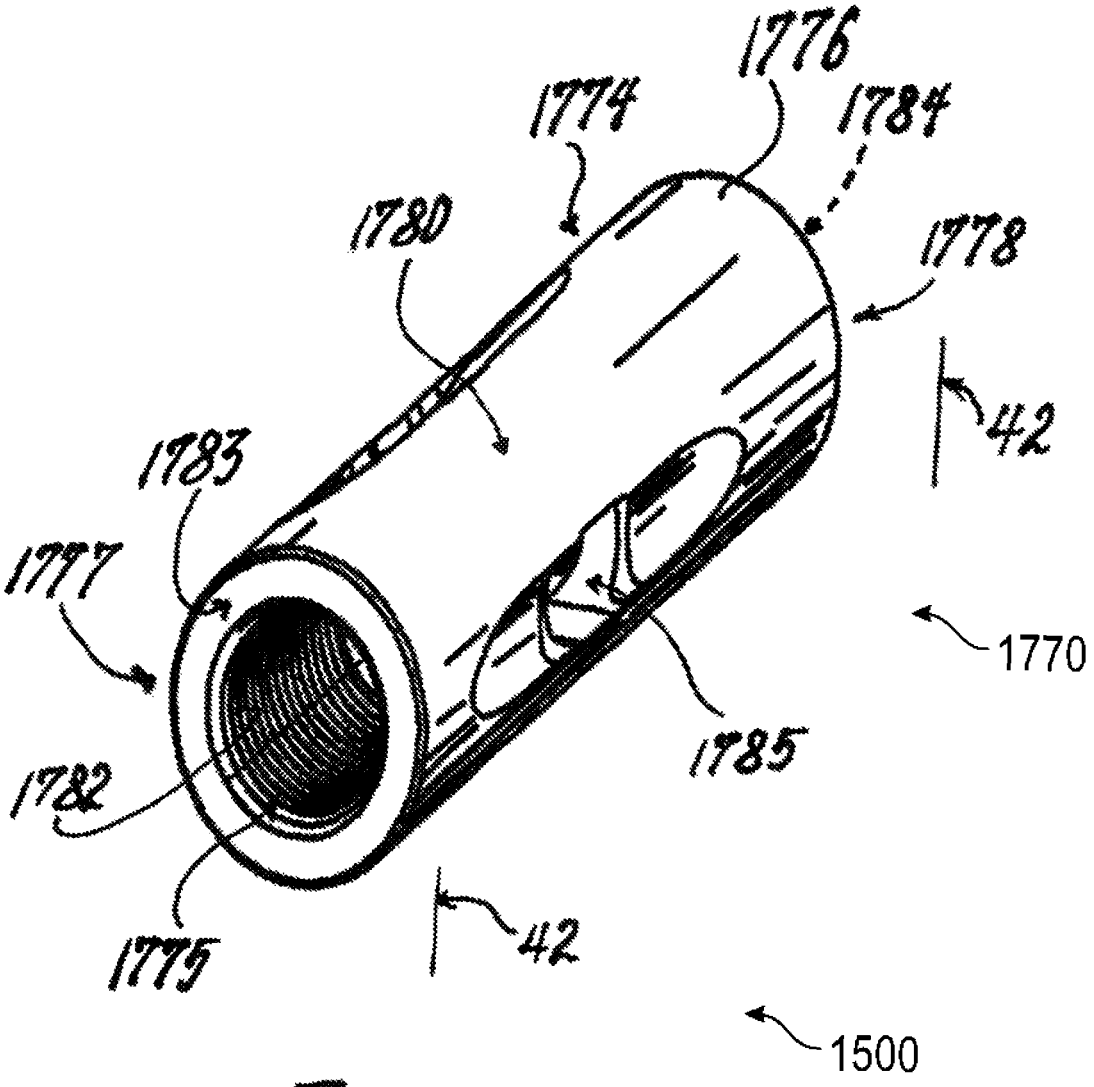
FIG. 40 is an enlarged simplified upper perspective isolation view of the actuator tube coupling for the pump actuator shown generally in FIGS. 14A-14C.
Figure 41:
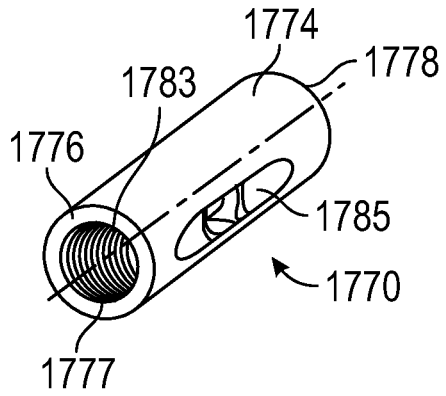
FIG. 41 is a simplified second perspective isolation view of the actuator tube coupling shown in FIG. 40.
Figure 43:
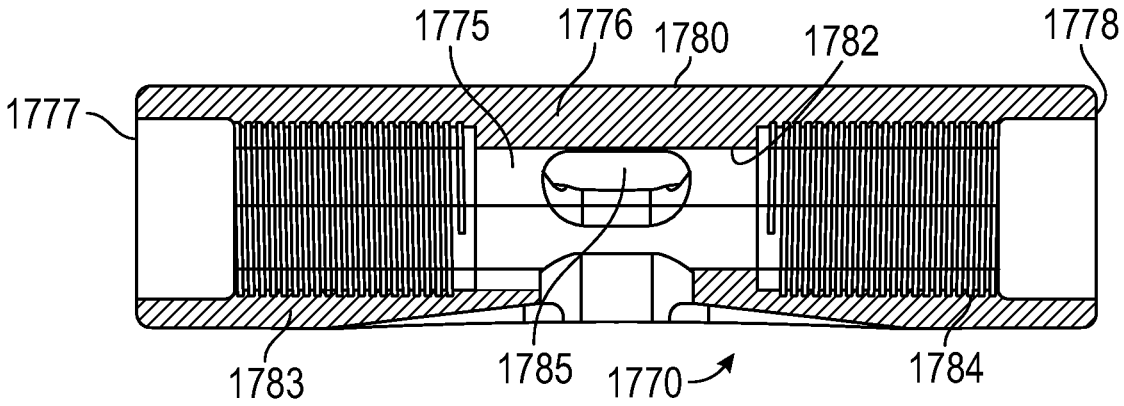
FIG. 43 is a simplified side cross-section view of the actuator tube coupling, taken generally along 43-43 in FIG. 42.
Figure 42:
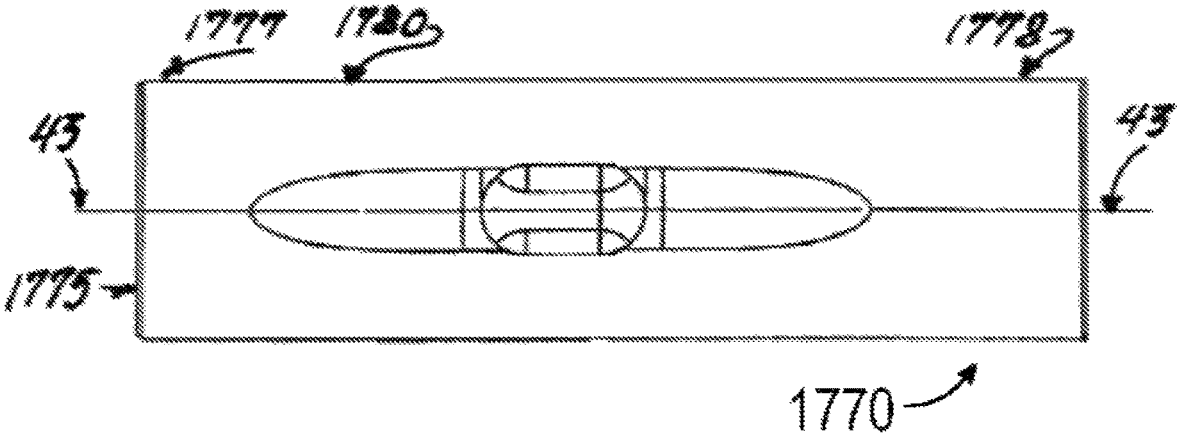
FIG. 42 is a simplified side view of the actuator tube coupling shown generally in FIG. 40.

FIG. 14A is a simplified schematic side view of the pump actuator 1510, having an actuator piston assembly 1550 located at bottom-end of a stroke. FIG. 14B is a view of the pump actuator 1510 shown in FIG. 14A with the actuator piston assembly 1550 at mid-stroke. FIG. 14C is a view of the pump actuator 1510 shown in FIGS. 14A-14B, with the actuator piston assembly 1550 at top-end of a stroke. FIG. 15 is an enlarged simplified, schematic partial cross-section view of the pump actuator 1510 with the actuator piston assembly 1550 at top-end of a stroke as shown in FIG. 14C, in combination with a plunger pump 1540.

Referring to FIGS. 14A-14C, pump actuator 1510 may include the actuator piston assembly 1550 supported for translation movement between the bottom-end position shown in FIG. 14A and the top-end position shown in FIG. 14C in cyclical reciprocating strokes, in relation to fixed actuator housing assembly. Referring to FIG. 15, it will be understood that strokes of actuator piston assembly 1550 drive corresponding strokes of plunger pump 1540 connected thereto in driven relationship. Particularly, strokes of the plunger pump 1540 consist of translation movement of the plunger body 1542 within fixed plunger housing 1544 between a top position (shown in FIG. 15) and bottom position (not shown). It will be understood that plunger pump 1540 may include a standing valve 1546 at bottom of the plunger housing 1544 and traveling valve 1548 which cooperate to prevent undesired backflow of production fluid into the reservoir and enable pressurization of production fluid for lifting upward from the plunger pump 1540 through pump actuator 1510 and into production tubing above the pump actuator 1510.

Referring to FIGS. 14A-14C, the actuator piston assembly 1550 may include an actuator piston body 1565 joined in fixed relationship with an elongated upper actuator tube 1570 and lower actuator tube 1575. Referring to FIGS. 32-35, actuator piston body 1565 may have a central portion 1580 intermediate an upper end 1585 and lower end 1590. The actuator piston assembly 1550 may include a set of external seals (not shown) disposed in corresponding recessed seats extending about the outer surface of actuator piston body 1565. The seals, for example, may be chevron seals or any seals configured to form a fluid-tight seal between actuator housing assembly and the outer surface of actuator piston body 1565. The oppositely disposed upper and lower ends 1582, 1584 of actuator piston body 1565 may be mirror image structures oppositely disposed along a longitudinal central axis 1586. A threaded orifice 1588 may extend between the upper and lower ends 1582, 1584 to receive the upper actuator tube 1570 and lower actuator tube 1575 in fixed, end-to-end alignment. The threaded orifice 1588 may include a pair of oppositely disposed sets of female piston body upper threads 1589*a* and piston body lower threads 1589*b*. The piston body upper threads 1589*a* may be configured for mating threaded engagement with corresponding male first threads 1572 of the upper actuator tube 1570 to join the actuator piston body 1565 in fixed relationship with upper actuator tube 1570. The piston body lower threads 1589*b* may be configured for mating threaded engagement with corresponding male first threads of the lower actuator tube 1575 to join the actuator piston body 1565 in fixed relationship with lower actuator tube 1575. The threaded orifice 1588 of actuator piston body 1565 joins the upper actuator tube 1570 and lower actuator tube 1575 in fixed end-to-end relationship in alignment along the piston assembly longitudinal axis 1586. The aligned upper actuator tube 1570 and lower actuator tube 1575 define an elongated primary flow path 1590 for production fluid to pass upward from the plunger pump 1540 through the actuator piston assembly 1550 to production tubing above the pump actuator 1510.

Referring to FIGS. 14A-14C and 36-39, each of the upper and lower actuator tubes 1570, 1575 may be identical. Each of the identical upper and lower actuator tubes 1570, 1575 may be an elongated tubular member having oppositely disposed first and second ends 1592, 1594. Each of the identical upper and lower actuator tubes 1570, 1575 may have an elongated actuator tube wall 1596 with an elongated cylindrical outer surface 1598. Each of the identical upper and lower actuator tubes 1570, 1575 may have an elongated, open actuator tube interior 1597 extending between the first end 1592 and second end 1594. Each of the upper and lower actuator tubes 1570, 1575 may have a set of male first threads 1572 defined in the actuator tube wall 1596 at first end 1592, and a set of male second threads 1573 defined in the actuator tube wall 1596 at second end 1594. The upper actuator tube 1570 may be joined in fixed relationship with the actuator piston body 1565 by the second end 1594 thereof being received in threaded orifice 1588 at upper end 1582 of actuator piston body 1565 such that mating threaded engagement is established between second threads 1573 and piston body upper threads 1589*a*. The lower actuator tube 1575 may be joined in fixed relationship with the actuator piston body 1565 by the first end 1592 thereof being received in threaded orifice 1588 at lower end 1584 of actuator piston body 1565 such that mating threaded engagement is established between first threads 1572 and piston body lower threads 1589*b*.

Referring to FIGS. 14A-14C and 28-31, actuator housing assembly 1605 may include an elongated, tubular actuator cylinder housing 1610 joined in fixed relationship with an upper end cap assembly 1640 and lower end cap assembly 1644. Actuator cylinder housing 1610 may be an elongated cylindrical tubular member having a cylinder wall 1620 defining a continuous cylinder outer surface 1622. Cylinder wall 1620 may include a continuous inner wall surface 1624 disposed in opposition to cylinder outer surface 1622 and defining an elongated cylinder interior space 1629. Cylinder wall 1620 may have opposite upper and lower ends 1615, 1617 aligned in common along a longitudinal housing axis 1618. Actuator cylinder housing 1610 may include a set of male first threads 1626 disposed at upper end 1615 and a set of male second threads 1628 disposed at lower end 1617.

Referring to FIGS. 14A-14C and 15-27, actuator housing assembly 1605 may include an upper end cap assembly 1640 and lower end cap assembly 1644 joined in fixed relationship with the actuator cylinder housing 1610 at cylinder upper end 1615 by mating threaded engagement with the first threads 1626 and cylinder lower end 1617 by mating threaded engagement with the second threads 1628. As further described herein, the upper end cap assembly 1640 and lower end cap assembly 1644 may be identical, with an interchangeable end cap bung 1650 installed in an end cap body 1655 to occupy a first orientation B in the upper end cap assembly 1640 (shown in FIGS. 15-16) and in an identical end cap body 1655 to occupy a second orientation B' in lower end cap assembly 1644 (shown in FIG. 15). Each of the identical upper and lower end cap assemblies 1640, 1644 includes an identical end cap body 1655 and end cap bung 1650 installed in the end cap body 1655 in one of two interchangeable positions B and B'. It will be understood that in the upper end cap assembly 1640, the end cap bung 1650 is installed in the end cap body 1655 in position B, and in the lower end cap assembly 1644 B' (shown in FIGS. 15-16) the end cap bung 1650 is installed in the respective end cap body 1655 in position B' (shown in FIG. 15). In other embodiments (not shown), the end cap assemblies may not have interchangeable configurations. It will be understood that in each of the upper and lower end cap assemblies 1640 and 1644, the end cap bung 1650 is oriented relative to the end cap body 1655 such that an end cap bung external port 1660 faces up for alignment with a respective external hydraulic tube (1530 shown in FIG. 44) extending downward from above the pump actuator 1510, for the aligned external port 1660 to receive the external hydraulic tube in secure mating engagement, such as mating compression fitting engagement or mating threaded engagement with a compatible fitting of the external hydraulic tube.

Referring to FIGS. 16-23, the end cap body 1655 is an elongated tubular member having an irregular exterior. End cap body 1655 has a first end 1665 disposed in opposition to a second end 1667. An elongated end cap primary orifice 1670 extends from first end 1665 to second end 1667 along a longitudinal axis 1672. End cap body 1655 includes a continuous end cap wall 1674 defining the primary orifice 1670 in the open interior thereof. End cap wall 1674 has an irregular external profile from first end 1665 to second end 1667. End cap body 1655 includes a set of female first threads 1676 defined in primary orifice 1670 proximate first end 1665. End cap body 1655 includes a set of male second threads 1678 proximate second end 1667. Primary orifice 1670 may include a set of seal recesses 1680 defined in a continuous internal surface 1682 of the end cap wall 1674 and spaced along the longitudinal axis 1672 proximate the second end 1667. The set of seal recesses 1680 are configured to receive respective seals (shown in FIGS. 14A-14C and 15) which form a fluid-tight barrier between the internal surface 1682 of end cap body 1655 and the outer surface 1598 of respective upper actuator tube 1570 or lower actuator tube 1575 extending there through. End cap wall 1674 includes a recessed bung seat 1684 defined in the end cap external surface 1686 intermediate the first threads 1676 and second threads 1678. End cap wall 1674 includes a bung seat orifice 1688 defined in the bung seat 1684. The bung seat orifice 1688 extends through end cap wall 1674 and intersects the primary orifice 1670 in an intermediate section 1692 thereof. The intermediate section 1692 of primary orifice 1670 is recessed at a continuous step 1694 formed in the end cap wall 1674, and thus from the step 1694 to the female set of second threads 1678 has an internal diameter greater than the diameter of the outer surface 1598 of the respective upper or lower actuator tube 1570, 1575 extending through the primary orifice 1670, such that an intermediate open annular space 1688 is defined in the primary orifice 1670 between the end cap wall 1674 and outer surface 1598 of the respective upper or lower actuator tube 1570, 1575. End cap second threads 1678 are formed in primary orifice 1670 proximate the second end 1667 of end cap wall 1674.

Referring to FIGS. 16-23, each of the upper and lower end cap assemblies 1640,1644 includes an end cap bung 1650 installed in the recessed bung seat 1684 of the end cap body 1655. The end cap bung 1650 includes a bung base 1705 configured for mating seated, abutting engagement with recessed bung seat 1684. End cap bung 1650 includes a bung hood 1710 opposite the bung base 1705. The end cap bung 1650 includes a continuous bung wall 1715 extending from bung base 1705 to bung hood 1710. End cap bung 1650 includes an external bung port 1720 defined in bung wall 1715 between bung hood 1710 and bung base 1705. External bung port 1720 defines an external bung orifice 1725 in bung wall 1715. End cap bung 1650 includes an internal bung port 1730 defined in bung base 1705 and facing primary orifice 1670 in end cap body 1655. The internal bung port 1730 defines internal bung orifice 1735 (see FIG. 26) intersecting the bung seat orifice 1688 at recessed bung seat 1684 for fluid communication with the primary orifice 1670 extending through end cap body 1655. The end cap bung 1650 includes a bung passage 1640 extending between the external bung port 1720 and internal bung port 1730. The bung passage 1640 has a ninety degree (90°) turn intermediate the external bung port 1720 and internal bung port 1730. The bung passage 1640 is in open communication with the annular space 1692 to enable flow of hydraulic fluid between the corresponding external hydraulic tube and respective of the actuator cylinder upper chamber 1760 via the upper end cap assembly 1640 or the actuator cylinder lower chamber 1765 via the lower end cap assembly 1640, to actuate and cause movement of the movable actuator piston assembly 1550 by creating a controlled pressure differential between hydraulic fluid in the actuator cylinder upper chamber 1760 and actuator cylinder lower chamber 1765.

Referring to FIGS. 14A-14C, 15 and 40-43, the hydraulic pump actuator 1510 may include a first tubular coupling 1770 configured for mating threaded engagement with the second threads 1573 at second end 1594 of lower actuator tube 1575. The hydraulic pump actuator 1510 also may include a second tubular coupling 1772 configured for mating threaded engagement with the first threads 1572 at first end 1592 of upper actuator tube 1570. In the particular embodiment illustrated herein, the first and second tubular couplings 1770, 1772 may be identical. Each of the first and second tubular couplings 1770, 1772 may include an elongated tubular coupling body 1774. The elongated tubular coupling body 1774 includes a cylindrical, continuous coupling tubular wall 1776 having opposite first and second ends 1777, 1778. Tubular coupling body 1774 includes an open coupling orifice 1775 extending between first and second ends 1777, 1778 to define a coupling flow path for production fluid to pass upward through the tubular coupling body 1774. The tubular coupling body 1774 may include the coupling wall 1776 having a continuous outer surface 1780 disposed in opposition to a continuous inner surface 1782. The coupling orifice 1775 may include a first set 1783 of internal threads proximate first end 1777 and a second set 1784 of internal threads proximate second end 1778. The tubular coupling body 1774 may include a plurality of accumulation orifices 1785 extending through the coupling wall 1776 between the outer surface 1780 and inner surface 1782 to provide open fluid communication between the coupling orifice 1775 and fluid accumulation space 1787 outside the respective first or second tubular coupling 1770, 1772. The first tubular coupling 1770 at second set 1784 of internal threads may be joined in mating threaded engagement with male threads of the plunger body 1542 to drive reciprocating strokes of the plunger body 1542 inside plunger housing 1544 to lift fluid into the fluid accumulation space 1787. The plurality of accumulation orifices 1785 in coupling tubular wall 1776 of tubular coupling body 1774 provide open fluid communication between the coupling orifice 1775 and fluid accumulation space 1787 outside the respective first or second tubular coupling 1770, 1772, such that production fluid lifted by stroking movement of the plunger body 1542 may be lifted into the lower actuator tube 1575 by suction and may pass upward through the fluid flow path in the actuator piston assembly 1550.

The disclosed subject matter provides a system, apparatus and method for artificial lift. Embodiments of disclosed subject matter provide a system, apparatus and method for artificial lift including a hydraulic downhole rodless pump actuator. Embodiments may provide energy and cost savings, reduced maintenance, reduced maintenance time, reduced maintenance expense, reduced complexity, increased precision of control, increased precision of actuation, increased useful life of artificial lift equipment, reduced mechanical loads on equipment, and apparatus and systems of simplified construction and operation.

In accordance with the preceding, one of ordinary skill in the art will understand that embodiments provide improved energy consumption for pumping, cost savings for operation, reduced maintenance, reduced maintenance time, reduced maintenance expense, reduced complexity, increased precision of control of pumping operations, increased precision of actuation, reduced mechanical loads on equipment, elimination of sucker rod strings and pump jacks for actuation, and simplified construction and operation.

While this disclosure has been particularly shown and described with reference to preferred embodiments thereof and to the accompanying drawings, it will be understood by those skilled in the art that various changes in form and details may be made therein without departing from the spirit of this disclosure. Therefore, the scope of the disclosure is defined not by the detailed description but by the appended claims.

What is claimed is:

1. An artificial lift system for a hydrocarbon production well, said system comprising:

an actuator housing assembly including an elongated cylindrical tubular housing sidewall having a first end and second end, an upper end cap configured for mating threaded engagement with the first end, a lower end cap configured for mating threaded engagement with the second end, cooperation of the upper end cap, lower end cap and housing sidewall defining an actuator housing interior;

an elongated actuator piston assembly supported for reciprocal translation stroke movement in relation to the actuator housing assembly, the actuator piston assembly including an actuator piston body joined in mating threaded engagement with an upper actuator tube and a lower actuator tube;

the actuator piston assembly having an actuator piston assembly production fluid passage extending through the actuator piston assembly from a lower end of the lower actuator tube to an upper end of the upper actuator tube, the upper actuator tube at the upper end thereof passing production fluid from the actuator piston assembly fluid passage to production tubing above the actuator housing assembly;

a tubular coupling below the actuator housing assembly, the tubular coupling having a tubular coupling sidewall defining a coupling flow passage for production fluid to pass upward through the tubular coupling to an upper end of the tubular coupling, the tubular coupling in mating threaded engagement with the lower actuator tube to pass production fluid upward into the lower actuator tube, the tubular coupling including a coupling accumulation orifice in the tubular sidewall, the coupling accumulation orifice providing open fluid communication with a production fluid accumulation space outside the tubular coupling sidewall.

2. An artificial lift system according to claim 1, said system comprising:

a hydraulic port connection on the lower end cap configured to enable flow of hydraulic fluid through a hydraulic fluid passage defined in the lower end cap in relation to a lower pressure chamber, the lower end cap having an internal wall including a continuous recess spaced apart from an outer surface of the lower actuator tube, the recess defining an annular fluid space of the lower pressure chamber, the lower end cap having a fluid-tight seal outward from the annular fluid space in the longitudinal direction, the fluid-tight seal confining hydraulic fluid in the lower pressure chamber.

3. An artificial lift system according to claim 1, said system comprising:

a plunger pump connected to the tubular coupling below the actuator housing assembly.

4. An artificial lift system according to claim 1, said system comprising:

a hydraulic system providing pressurized hydraulic fluid to the actuator housing interior to drive reciprocating translation stroke movement of the actuator piston assembly relative to the actuator housing assembly.

5. An artificial lift system according to claim 1, said system comprising:

the actuator piston body dividing the actuator housing interior into an upper chamber and lower chamber.

6. An artificial lift system according to claim 1, said system comprising:

the actuator piston body having a second piston body aperture configured to receive an upper end of the lower actuator tube in mating engagement therewith;

the actuator piston body having a first piston body aperture configured to receive a lower end of the upper actuator tube in mating engagement therewith;

the lower end of the upper actuator tube received in the first piston body aperture in proximal end to end relationship with the upper end of the lower actuator tube;

cooperation of the lower actuator tube and upper actuator tube with the actuator piston body defining the actuator piston assembly production fluid passage.

7. A hydraulic actuator assembly for artificial lift of production fluid in a hydrocarbon production well, said hydraulic actuator assembly comprising:

an actuator housing assembly including an elongated cylindrical tubular housing sidewall having a first end and second end, an upper end cap configured for mating threaded engagement with the first end, a lower end cap configured for mating threaded engagement with the second end, cooperation of the upper end cap, lower end cap and housing sidewall defining an actuator housing interior;

an elongated actuator piston assembly supported for reciprocal translation stroke movement in relation to the actuator housing assembly, the actuator piston assembly including an actuator piston body joined in mating threaded engagement with an upper actuator tube and a lower actuator tube;

the actuator piston assembly having an actuator piston assembly production fluid passage extending through the actuator piston assembly from a lower end of the lower actuator tube to an upper end of the upper actuator tube, the upper actuator tube at the upper end thereof passing production fluid from the actuator piston assembly fluid passage to production tubing above the actuator housing assembly;

a tubular coupling below the actuator housing assembly, the tubular coupling having a tubular coupling sidewall defining a coupling flow passage for production fluid to pass upward through the tubular coupling to an upper end of the tubular coupling, the tubular coupling in mating threaded engagement with the lower actuator tube to pass production fluid upward into the lower actuator tube, the tubular coupling including a coupling accumulation orifice in the tubular sidewall, the coupling accumulation orifice providing open fluid communication with a production fluid accumulation space outside the tubular coupling sidewall.

8. A hydraulic actuator assembly according to claim 7, said hydraulic actuator assembly comprising:

a hydraulic port connection on the lower end cap configured to enable flow of hydraulic fluid through a hydraulic fluid passage defined in the lower end cap in relation to a lower pressure chamber, the lower end cap having an internal wall including a continuous recess spaced apart from an outer surface of the lower actuator tube, the recess defining an annular fluid space of the lower pressure chamber, the lower end cap having a fluid-tight seal outward from the annular fluid space in the longitudinal direction, the fluid-tight seal confining hydraulic fluid in the lower pressure chamber.

9. A hydraulic actuator assembly according to claim 7, said hydraulic actuator assembly comprising:

the tubular coupling connected to a plunger pump below the actuator housing assembly.

10. A hydraulic actuator assembly according to claim 7, said hydraulic actuator assembly comprising:

the actuator housing assembly configured to receive pressurized hydraulic fluid in the actuator housing interior to drive reciprocating translation stroke movement of the actuator piston assembly relative to the actuator housing assembly.

11. A hydraulic actuator assembly according to claim 7, said hydraulic actuator assembly comprising:

the actuator piston body dividing the actuator housing interior into an upper chamber and lower chamber.

12. A hydraulic actuator assembly according to claim 7, said hydraulic actuator assembly comprising:

the actuator piston body having a second piston body aperture configured to receive an upper end of the lower actuator tube in mating engagement therewith;

the actuator piston body having a first piston body aperture configured to receive a lower end of the upper actuator tube in mating engagement therewith;

the lower end of the upper actuator tube received in the first piston body aperture in proximal end to end relationship with the upper end of the lower actuator tube;

cooperation of the lower actuator tube and upper actuator tube with the actuator piston body defining the actuator piston assembly production fluid passage.

* * * * *